US009505552B2

(12) United States Patent
Mak et al.

(10) Patent No.: US 9,505,552 B2
(45) Date of Patent: Nov. 29, 2016

(54) LID OPENER

(71) Applicants: Kenneth S. Mak, San Francisco, CA (US); Elia S. Mak, San Francisco, CA (US)

(72) Inventors: Kenneth S. Mak, San Francisco, CA (US); Elia S. Mak, San Francisco, CA (US)

( * ) Notice: Subject to any disclaimer, the term of this patent is extended or adjusted under 35 U.S.C. 154(b) by 310 days.

(21) Appl. No.: 14/028,980

(22) Filed: Sep. 17, 2013

(65) Prior Publication Data

US 2015/0075330 A1 Mar. 19, 2015

(51) Int. Cl.
*B65F 1/14* (2006.01)

(52) U.S. Cl.
CPC ..... *B65F 1/1623* (2013.01)

(58) Field of Classification Search
CPC ..... B65F 1/1623; A47J 45/10; B67B 7/14; B67B 7/15; B67B 7/16
USPC ..... 81/3.27, 484, 488; 294/10–12, 22, 23, 294/23.5, 209
See application file for complete search history.

(56) References Cited

U.S. PATENT DOCUMENTS 55,894 A 6/1866 Old
698,161 A 4/1902 Washburn
1,225,601 A * 5/1917 Edmonds ..... A47J 45/10 294/12
1,581,119 A * 4/1926 Herring ..... B25F 1/00 157/1.3
2,905,036 A * 9/1959 Ledford ..... B60T 17/221 81/484
4,133,363 A * 1/1979 Gardner ..... B60C 25/132 157/1.3
4,781,352 A 11/1988 Youngman
4,903,683 A 2/1990 Larsen et al.
7,108,304 B2 9/2006 White
8,141,743 B1 3/2012 Corrigan
2006/0097529 A1 5/2006 White

OTHER PUBLICATIONS

International Search Report and Written Opinion dated Dec. 29, 2014 issued in corresponding International Application No. PCT/US2014/055890.

* cited by examiner

*Primary Examiner* — Hadi Shakeri
(74) *Attorney, Agent, or Firm* — Onello & Mello, LLP

(57) ABSTRACT

A lid opener includes a handle and an opening mechanism extending from the handle. The opening mechanism includes at least two projection members. Each of the projection members extends from the handle at an angle with respect to a longitudinal axis of the handle, and the projection members are spaced apart from each other for insertion of a lid between first and second adjacent projection members. A lid opener mount may also be included to couple the lid opener to a surface.

13 Claims, 29 Drawing Sheets

LID OPENER

FIELD OF INVENTION

The present inventive concepts relate to a lid opener, and more particularly to a lid opener for opening a lid of a trash receptacle.

BACKGROUND

Typical trash or waste receptacles are top-loading containers having bulky lids. The opening of the lid of most trash receptacles requires a person to exert some force in order to push or pull open the lid and throw the trash away. In addition, trash receptacle lids are often dirty. When opening the dirty lids, the person opening the lid of the trash receptacle may get dirty. For example, harmful germs and bacteria can be transmitted to the hand of the person.

There are many types of trash and waste receptacles, including, for example, trash bins, recycle bins, compost bins, metal bins, oil bins, or wood bins. Consumer (namely, residential) trash receptacles and commercial (namely, industrial) trash receptacles have many constructions. The lids of the consumer and commercial trash receptacles may be categorized based on how the lid can be opened in relation to the bottom container, for example, with lips, without lips and/or with handles. Lids with lips are often opened by a user pushing up on the lip. Lids without lips are often opened by a user pushing up on the edge of the lid. Lids with handles are often opened by pulling up on or lifting the handles.

SUMMARY OF INVENTION

In accordance with one aspect of the inventive concepts, provided is a lid opener. The lid opener includes a handle and an opening mechanism extending from the handle, either or both of which can include an antibacterial agent. The opening mechanism comprising one or more projection members configured to engage a portion of a lid. When there is more than one projection member, at least one of the projection members extends from the handle at a non-zero angle with respect to the handle.

In some embodiments, one of the projection members extends from the handle along a longitudinal axis of the handle.

In some embodiments, the at least two projection members form an opening configured to engage the portion of the lid.

In some embodiments, the at least two projection members comprise a first projection member and a second projection member and an angle between the first and second projection members is substantially 180°. In some embodiments, the at least two projection members further comprises a third projection member disposed between the first and second projection members and an angle between the third projection member and each of the first and second projection members is substantially 90°.

In some embodiments, the at least two projection members comprises a first projection member and a second projection member and an angle between the first and second projection members is less than 90°.

In some embodiments, the at least two projection members consists of first, second, and third projection members, and the first projection member extends outward from the handle in a first direction at a first angle, the second projection member extends outward from the handle in a second direction at a second angle, and a third projection member extends outward from the handle in a third direction and between the first and second projection members. In some embodiments, the third projection member is substantially perpendicular to at least one of the first and second projection members. In some embodiments, the first direction is a downward direction and the first angle is about a 60° angle from a first side of the handle. In some embodiments, the second direction is an upward direction and the second angle is about a 120° angle from a second side of the handle, wherein the second side of the handle is opposite the first side of the handle.

In some embodiments, corners between each of the projection members and between the projection members and the handle are filleted.

In some embodiments, the handle and the opening mechanism are a unitary device.

In some embodiments, the opening mechanism further comprises a rigid core and the handle comprises a grip overmolded around the core. In some embodiments, the grip comprises at least one of plastic, rubber, urethanes, thermosets or a combination thereof.

In some embodiments, at least one of the projection members is adjustable with respect to the handle.

In accordance with another aspect of the inventive concepts, provided is a lid opener. The lid opener includes a handle and a head mechanism. The head mechanism includes a first prong extending in a first direction at a first angle, a second prong extending in a second direction at a second angle, the second direction being opposite the first direction, and a third prong extending in a third direction, the third prong extending between the first and second prongs. The first direction is a downward direction with respect to a first side of the handle.

In some embodiments, the first angle is a substantially 60° angle from a first side of the handle. In some embodiments, the second direction is an upward direction and the second angle is a substantially 120° angle from a second side of the handle, wherein the second side of the handle is opposite the first side of the handle. In some embodiments, In some embodiments, the third direction is substantially perpendicular to the first and second directions.

In some embodiments, the corners between each of the projection members and between the projection members and the handle are filleted.

In some embodiments, the body and the opening mechanism are a unitary device.

In some embodiments, the opening mechanism further comprises a core and the body is overmolded around the core.

In some embodiments, the body and the opening mechanism comprise at least one of plastic, metal, wood, urethanes, thermosets or combination thereof.

In accordance with another aspect of the inventive concepts, provided is a lid opener kit. The lid opener kit includes a lid opener which includes a handle and an opening mechanism extending from the handle, the opening mechanism comprising at least two prongs configured to engage a portion of a lid, wherein at least one of the prongs extends from the handle at a non-zero angle with respect to the handle. The lid opener kit further includes a lid opener mount configured to removably couple the lid opener to a surface.

In some embodiments, the lid opener and the lid opener mount are configured for a magnetic engagement.

A lid opener as shown and described.

A lid opener kit as show and described.

A lid opening method as shown and described.

DESCRIPTION OF DRAWINGS

The present invention will become more apparent in view of the attached drawings and accompanying detailed description. The embodiments depicted therein are provided by way of example, not by way of limitation, wherein like reference numerals refer to the same or similar elements. The drawings are not necessarily to scale, emphasis instead being placed on illustrating aspects of the invention. In the drawings.

DETAILED DESCRIPTION OF PREFERRED EMBODIMENTS

Various exemplary embodiments will be described more fully hereinafter with reference to the accompanying drawings, in which some exemplary embodiments are shown. The present inventive concept may, however, be embodied in many different forms and should not be construed as limited to the exemplary embodiments set forth herein.

It will be understood that, although the terms first, second, etc. are be used herein to describe various elements, these elements should not be limited by these terms. These terms are used to distinguish one element from another, but not to imply a required sequence of elements. For example, a first element can be termed a second element, and, similarly, a second element can be termed a first element, without departing from the scope of the present invention. As used herein, the term "and/or" includes any and all combinations of one or more of the associated listed items.

It will be understood that when an element is referred to as being "on" or "connected" or "coupled" to another element, it can be directly on or connected or coupled to the other element or intervening elements can be present. In contrast, when an element is referred to as being "directly on" or "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, steps, operations, elements, and/or components, but do not preclude the presence or addition of one or more other features, steps, operations, elements, components, and/or groups thereof.

Spatially relative terms, such as "beneath," "below," "lower," "above," "upper" and the like may be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as "below" and/or "beneath" other elements or features would then be oriented "above" the other elements or features. The device may be otherwise oriented (e.g., rotated 90 degrees or at other orientations) and the spatially relative descriptors used herein interpreted accordingly.

Figure 1A:
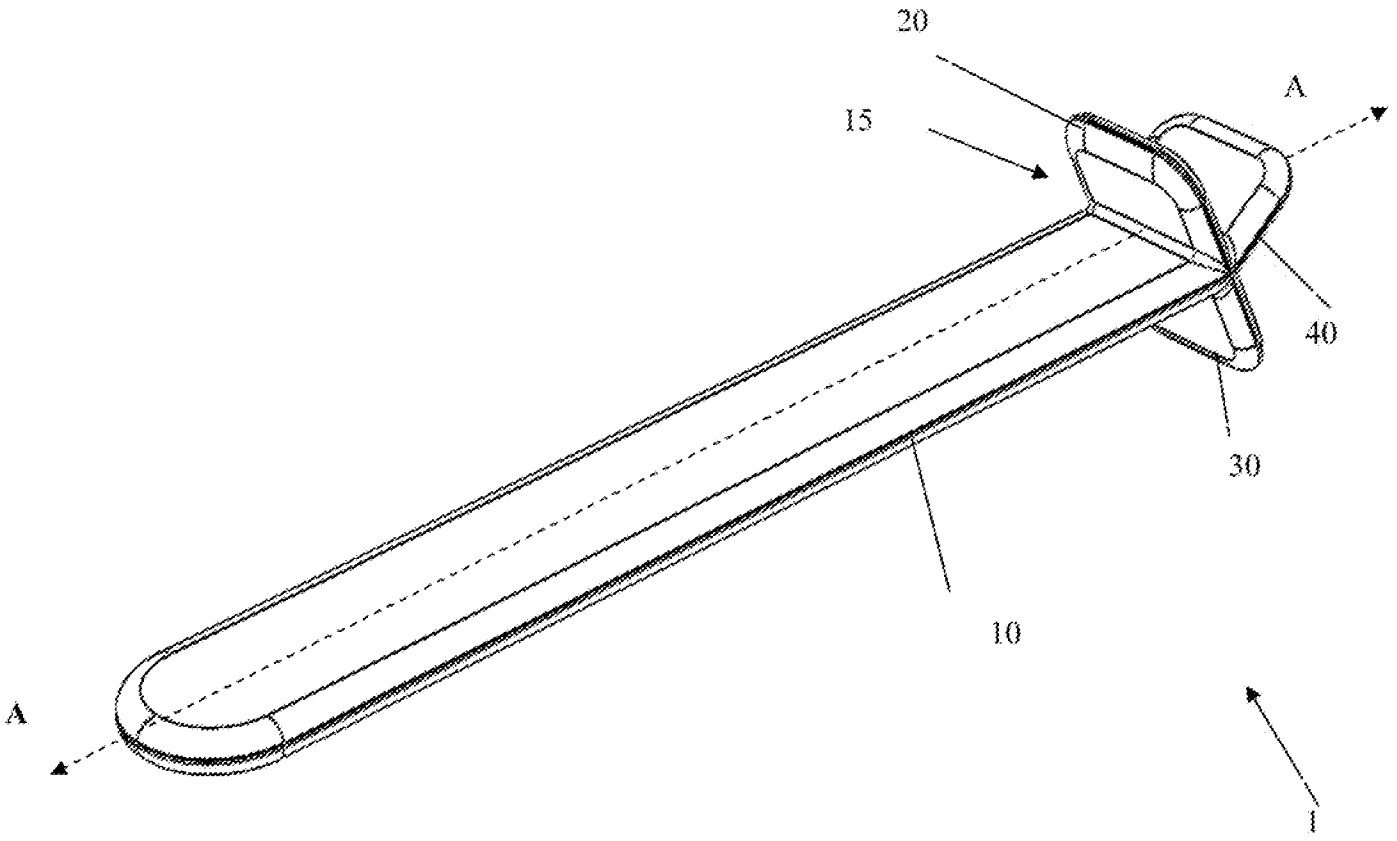
FIGS. 1A, 1B and 1C are perspective views of a trash receptacle lid opener, in accordance with the present inventive concepts.
Figure 1B:
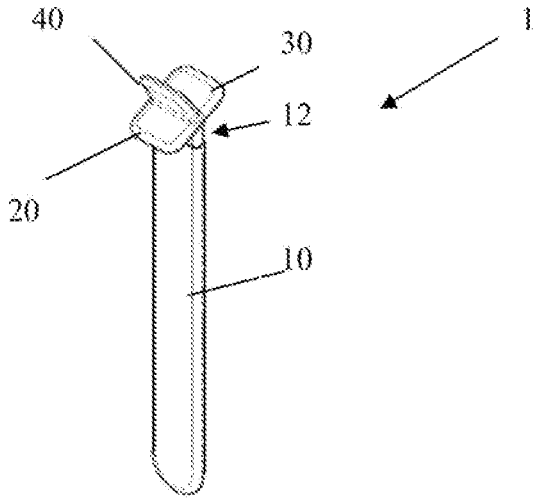
Figure 1C:
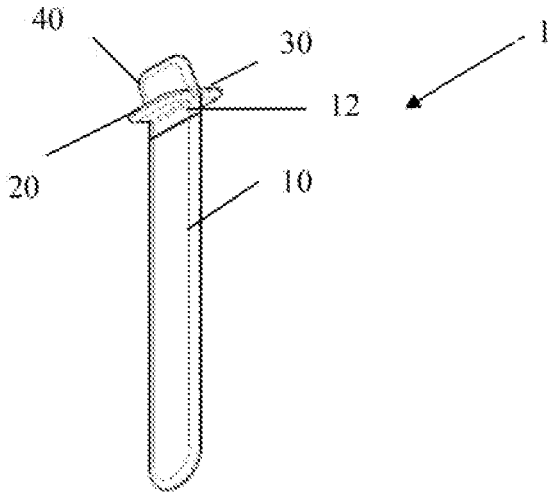
Figure 2A:
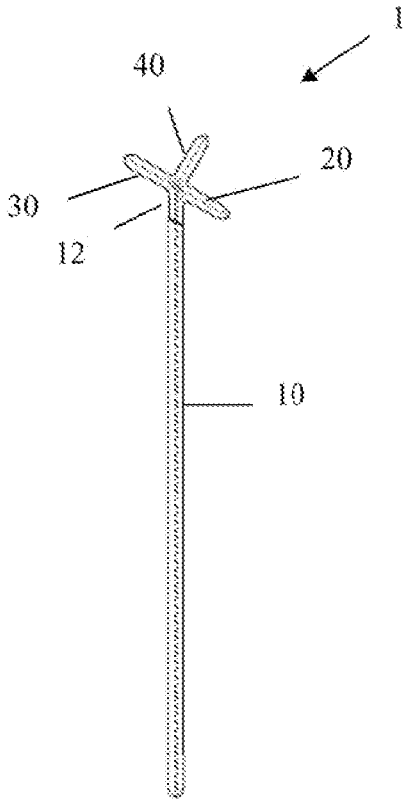
FIGS. 2A, 2B and 2C are side views of the lid opener of FIGS. 1A-1C.
Figure 2B:
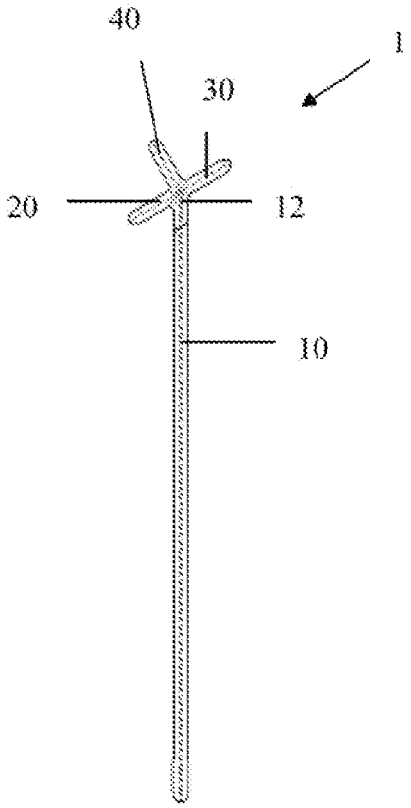
Figure 2C:
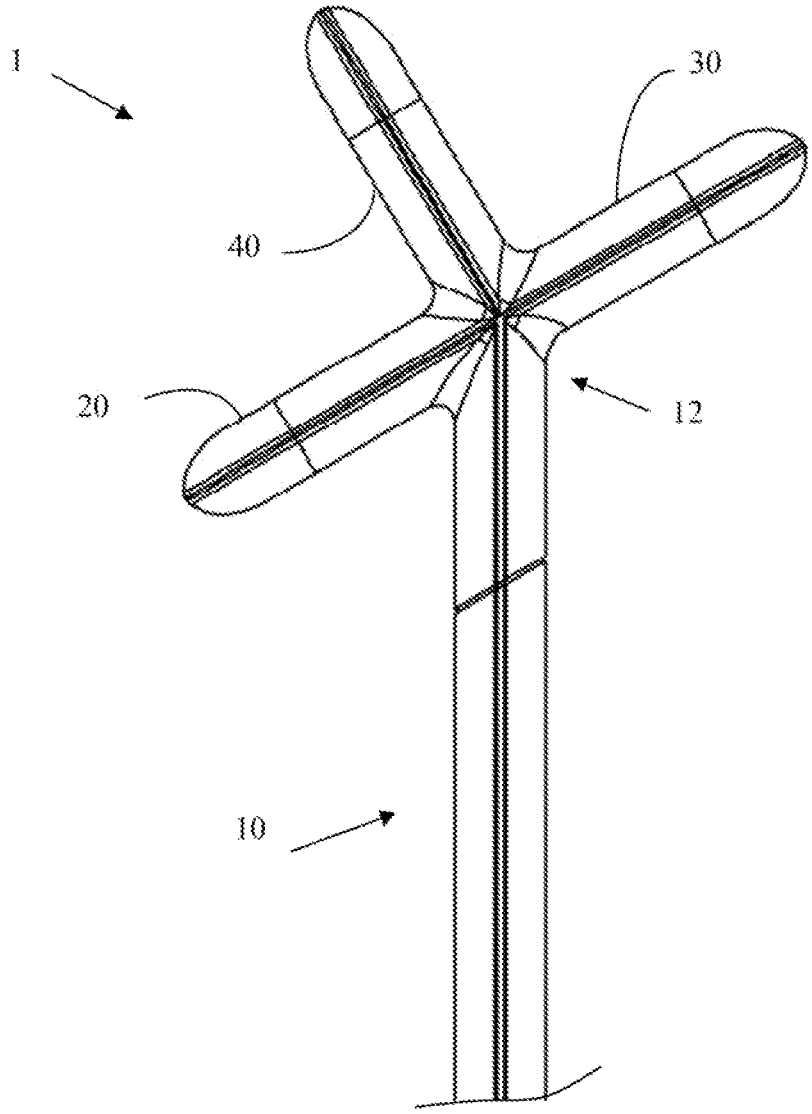
Figure 2D:
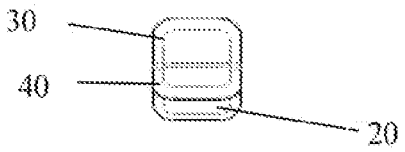
FIG. 2D is a top view of the lid opener of FIGS. 1A-1C.
Figure 2E:
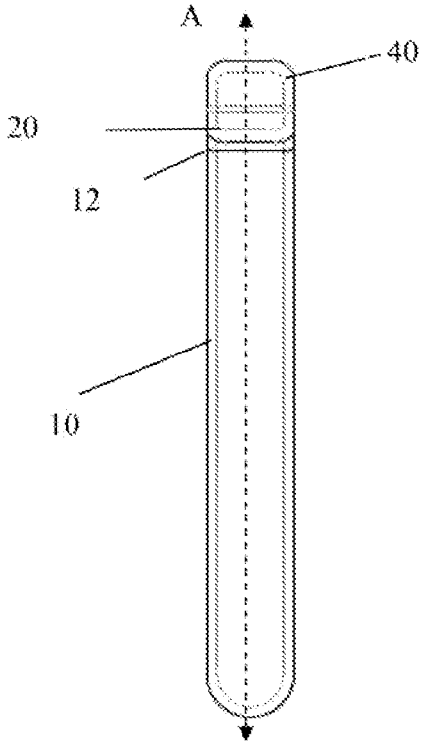
FIG. 2E is a front view of the lid opener of FIGS. 1A-1C.
Figure 2F:
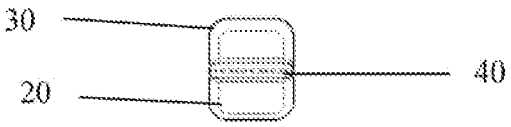
FIG. 2F is a bottom view of the lid opener of FIGS. 1A-1C.

FIGS. 1A, 1B and 1C are perspective views of a trash receptacle lid opener 1, in accordance with the present inventive concepts. FIG. 1A shows the device as a single unit and FIGS. 1B, 1C, 2A-2F, and 3A-3B show the device as a two-part unit. These different embodiments are referred to collectively, unless otherwise noted. FIGS. 2A, 2B and 2C are side views of the lid opener 1 of FIGS. 1A-1C, FIG. 2D is a top view of the lid opener 1 of FIGS. 1A-1C, FIG. 2E is a front view of the lid opener 1 of FIGS. 1A-1C, and FIG. 2F is a bottom view of the lid opener 1 of FIGS. 1A-1C.

The lid opener 1 is a tool used to open lids of various types of bins and receptacles, for example, trash bins, recycle bins, compost bins, metal bins, oil bins, wood bins, and so on, basically anything with a lid that sits indoors or outdoors. The lid opener 1 enables a user to open a trash receptacle by lip, edge, handle, or other feature without coming in skin contact with the lid, by either a push or pull action. All, or select portions of, the lid opener 1 may include, be coated with, or be treated with an antibacterial agent.

The lid opener 1 may be made as one unitary device or may have multiple parts, as noted above. The lid opener 1 may be formed of at least one of plastic, metal, a combination of metal and plastic or other structurally rigid materials, for example, wood, urethanes, thermosets, or the like, or a combination thereof. Other materials could also be used, the foregoing not being an exhaustive list.

In this embodiment, the lid opener 1 is an elongate device having a substantially straight handle 10 and a head 15 is formed at a distal end of the handle. In the case of a straight handle, a longitudinal axis A may be said to extend lengthwise through the handle. In other embodiments, the handle may be curved, or another hold-able shape, and may or may not include texture, dimples, divots, and so on.

In this embodiment, the head 15 includes a plurality of extending prongs, namely, first, second and third projection members, or prongs, 20, 30 and 40, respectively, in the embodiment depicted. The first, second and third prongs 20, 30 and 40 extend from a distal end of the handle 10 and are spaced apart from each other. In this embodiment, the prongs 20, 30, and 40 extend from the same portion of head 15, which is proximate to a distal end of handle 10. Thus, prongs 20, 30, and 40 may be considered to have a common vertex in this embodiment. In other embodiments, one or more of the prongs may extend from a different part of head 15, e.g., as shown in FIGS. 9A-9F.

The portion of head 15 from which the first, second and third prongs 20, 30 and 40 extend may be referred to as a neck 12. Neck 12 is located between the handle and the first, second and third prongs 20, 30 and 40, and may be considered to be part of the head.

The first prong 20 extends outward from the neck 12 in a downward direction at a first angle. A downward direction means the prong extends between 0-90 degrees with respect to a proximate side of the handle. In the depicted embodiment, the first angle is a 60 degree angle with respect to a first side of the handle 10.

The second prong 30 extends outward from the neck 12 and the handle 10 in an upward direction at a second angle. Therefore, an upward direction means the prong extends between 90-180 degrees with respect to a proximate side of the handle. In this embodiment, the second prong 30 extends in a direction opposite to that of the first prong 20. In some embodiments, the second angle is a 120 degree angle from a second side of the handle 10. Therefore, the second side of the handle is opposite to the first side of the handle in this embodiment.

The third prong 40 extends outward from the neck 12 and the handle 10 in an upward direction with respect to the first side of handle 10 at a third angle. That is, the third prong 40 extends between the first and second prongs. In some embodiments, such as that shown, the third prong can extend in a direction substantially perpendicular to the first and second prongs. That is, the third prong can extend between the first and second prongs at a 90 degree angle. It follows, therefore, that in this embodiment the third angle can be a 150 degree angle from the first side of the handle and a 210 degree angle from the second side of the handle. In other embodiments, third prong 40 need not be at a right angle with respect to either of the first and second prongs 20, 30.

As is illustrated in FIG. 2C, the inner corners of the lid opener 1 may be filleted in order to help the trash receptacle lid rotate when engaged. That is, the corners between first, second and third prongs 20, 30 and 40, respectively, and between the first and second prongs 20 and 30 and the handle 10, respectively, may be rounded. However, such features are not essential to the invention.

Figures 3A, 3B:
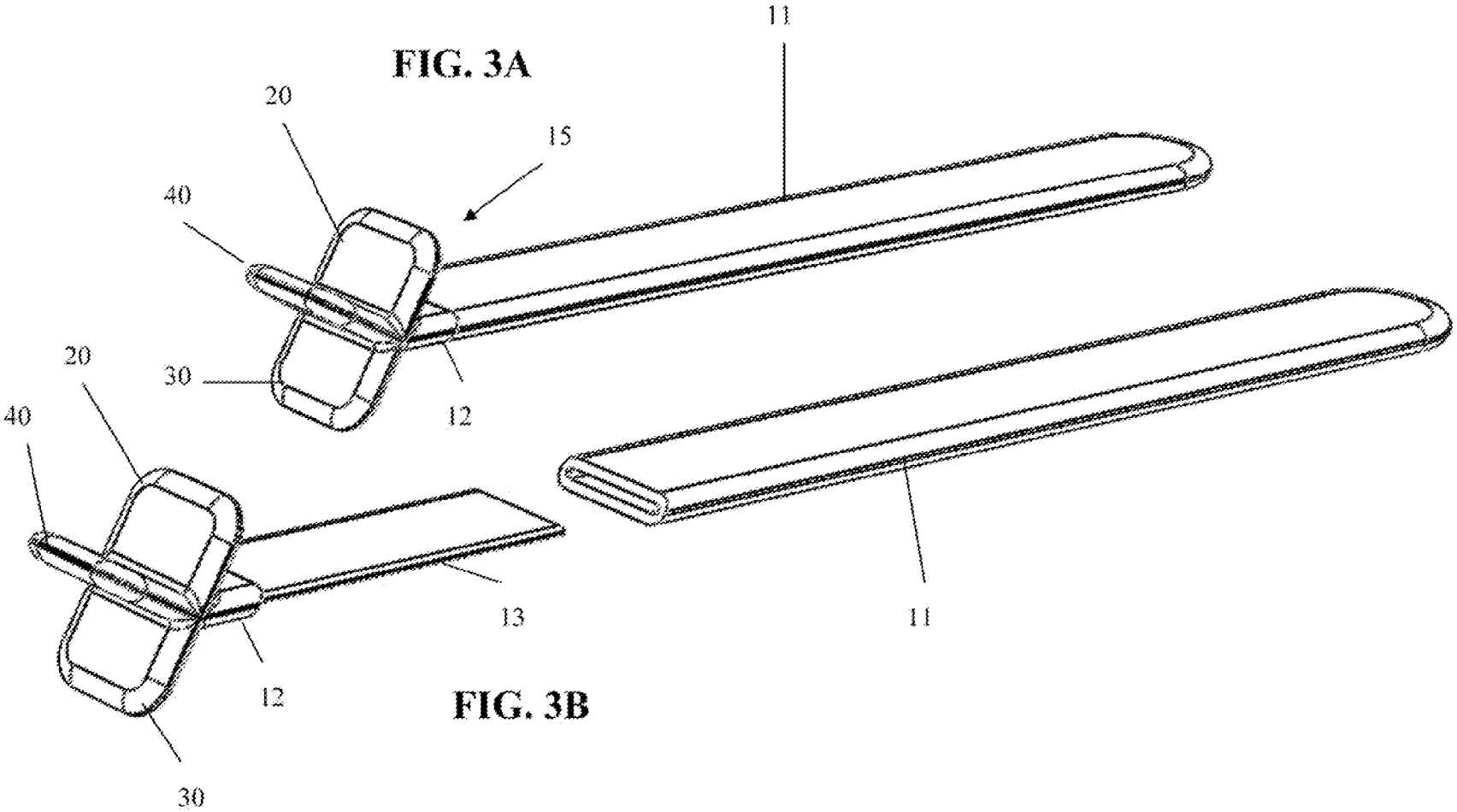
FIG. 3A is a perspective view of a trash receptacle lid opener, in accordance with the present inventive concepts.
FIG. 3B is an exploded perspective view of the lid opener of FIG. 3A.

FIG. 3A is a perspective view of the trash receptacle lid opener 1 of FIGS. 1B, 1C and 2A-2F, in accordance with the present inventive concepts, FIG. 3B is an exploded perspective view of the lid opener of FIG. 3A. In the embodiment of FIGS. 3A and 3B, the lid opener has first and second parts.

The first part includes head 15 with the first, second and third prongs 20, 30 and 40, the neck 12 and a rigid core 13. The rigid core 13 is connected to or integral with the neck 12. The first part may be a single rigid piece. The first part may be formed of for example, a die-cast metal, wherein rigid core 13 may be a metal core 13.

The second part includes a grip 11 which can be made, for example, from an overmolded plastic, rubber, urethanes, thermosets or the like, or combinations thereof. The grip 11 may include an antibacterial agent molded therein.

As illustrated in FIGS. 3A and 3B, grip 11 is overmolded around or to at least partially receive and encase the rigid core 13, and can provide a degree of dampening as force is applied to the grip 11.

Figure 4:
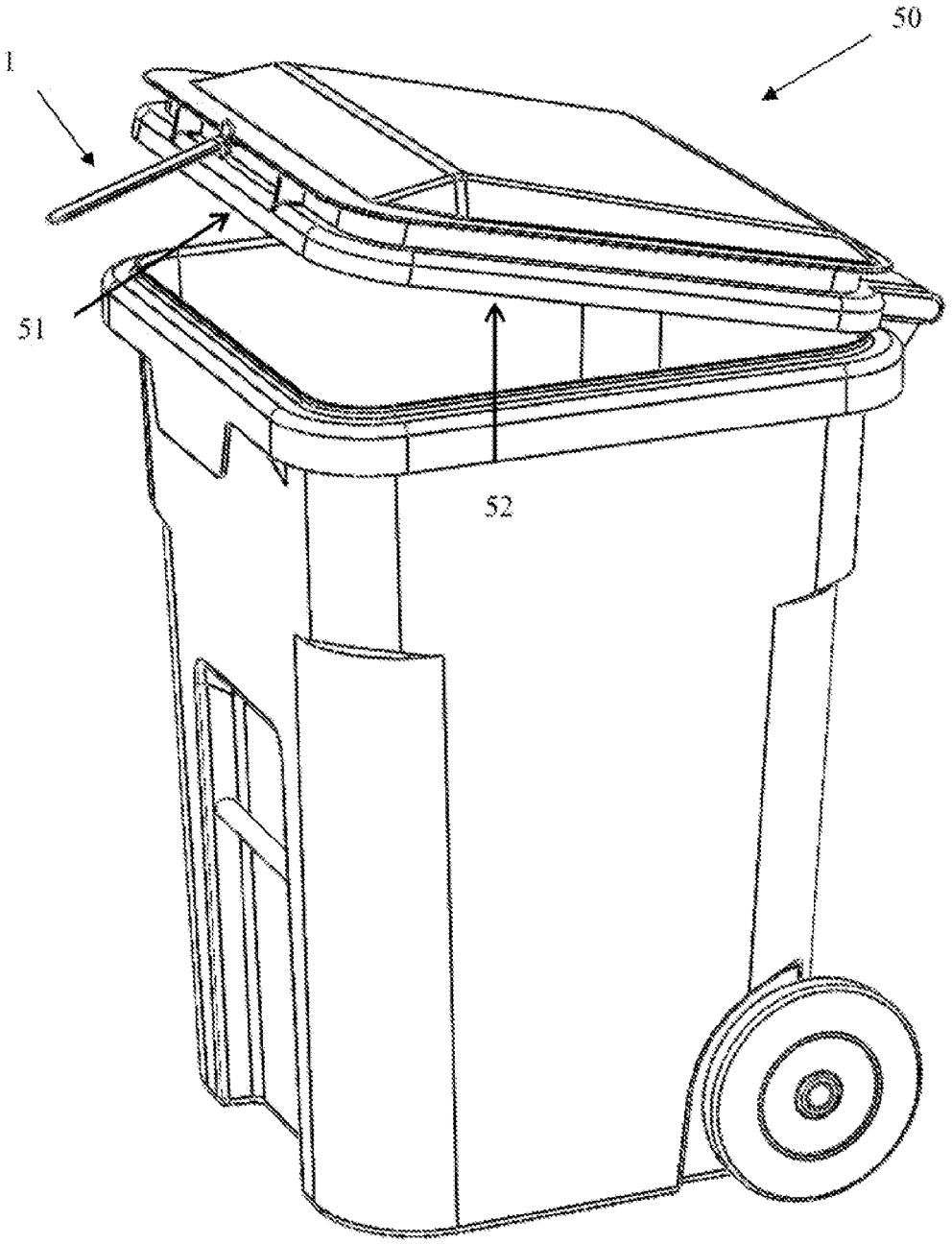
FIG. 4 is a perspective view illustrating the lid opener of FIGS. 1A-1C opening a lid of a trash receptacle.

FIG. 4 is a perspective view illustrating the lid opener 1 of FIGS. 1A-1C opening a lid of a trash receptacle 50. The lid opener 1 is constructed and arranged such that pushing, pulling, lifting, or pressing actions may be used to open a variety of trash receptacle lids. The lid opener 1 may interact with a front edge 51 of the lid of the trash receptacle 50. Alternatively, the lid opener 1 may interact with a side edge 52 of the lid of the trash receptacle 50. The particular engagement can depend on the particular edges of the lid and the orientation of the user with respect to the lid. The lid opener is preferably configured, therefore, to accommodate different types of lids and user orientations.

FIGS. 5A-D are perspective views illustrating the lid opener 1 opening lids of trash receptacles 50.

Figure 5A:
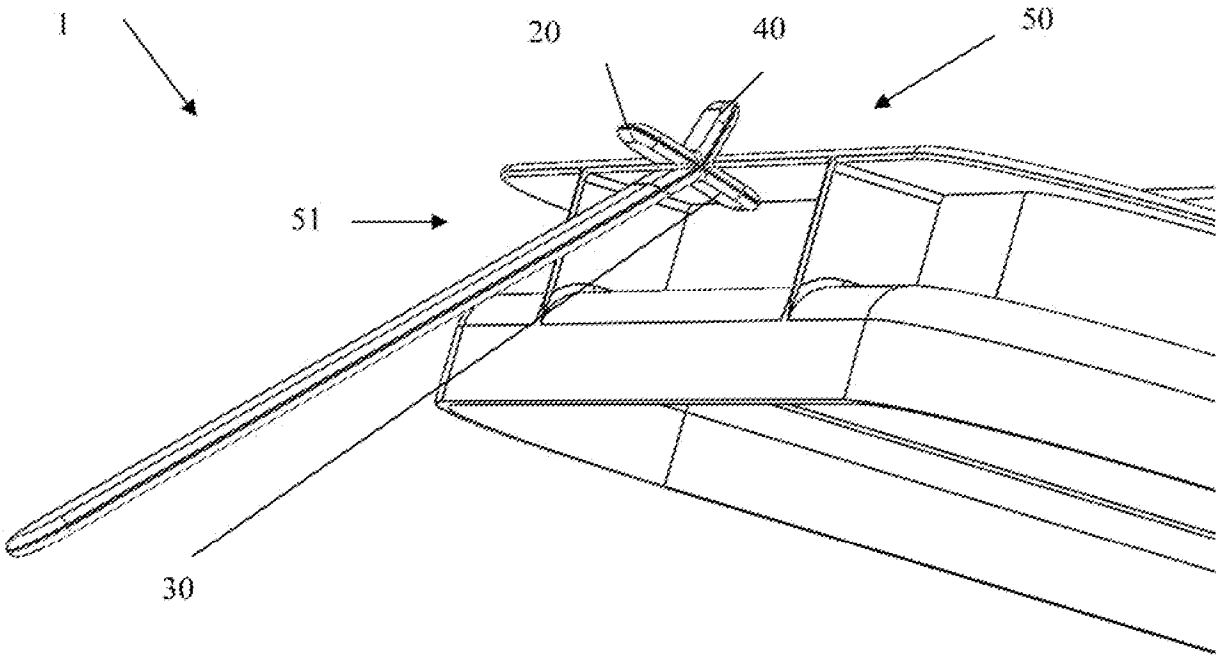
FIGS. 5A-D are perspective views illustrating the lid opener of FIGS. 1A-1C opening lids of trash receptacles.

FIG. 5A illustrates a pressing action of the lid opener 1. The lid of the trash receptacle 50 is engaged between the second prong 30 and the third prong 40. In this orientation, first prong 20 extends away from the trash receptacle 50. A press or push action may be initiated by the user applying an upward and forward force to the lid, to translate or rotate the lid upward and open.

Figure 5B:
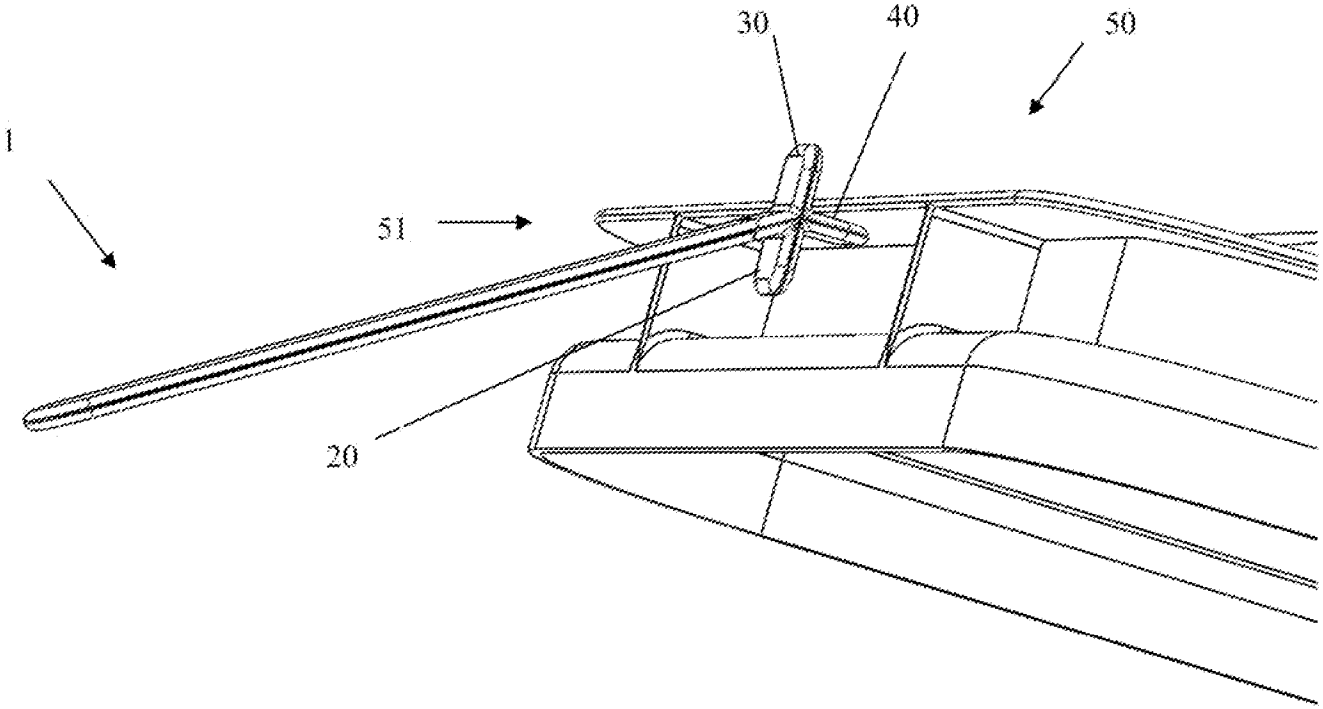

FIG. 5B illustrates a second form or pressing (or pushing) action of the lid opener 1 to open lid 50. The lid opener is flipped 180 degrees with respect to the orientation shown in FIG. 5A. The lid of the trash receptacle 50 is engaged between the second prong 30 and the third prong 40. In this orientation, first prong 20 extends in a downward direction. A press action is initiated with the user pressing forward, toward the trash receptacle 50, and upward, which translates or rotates the lid upward to open.

Figure 5C:
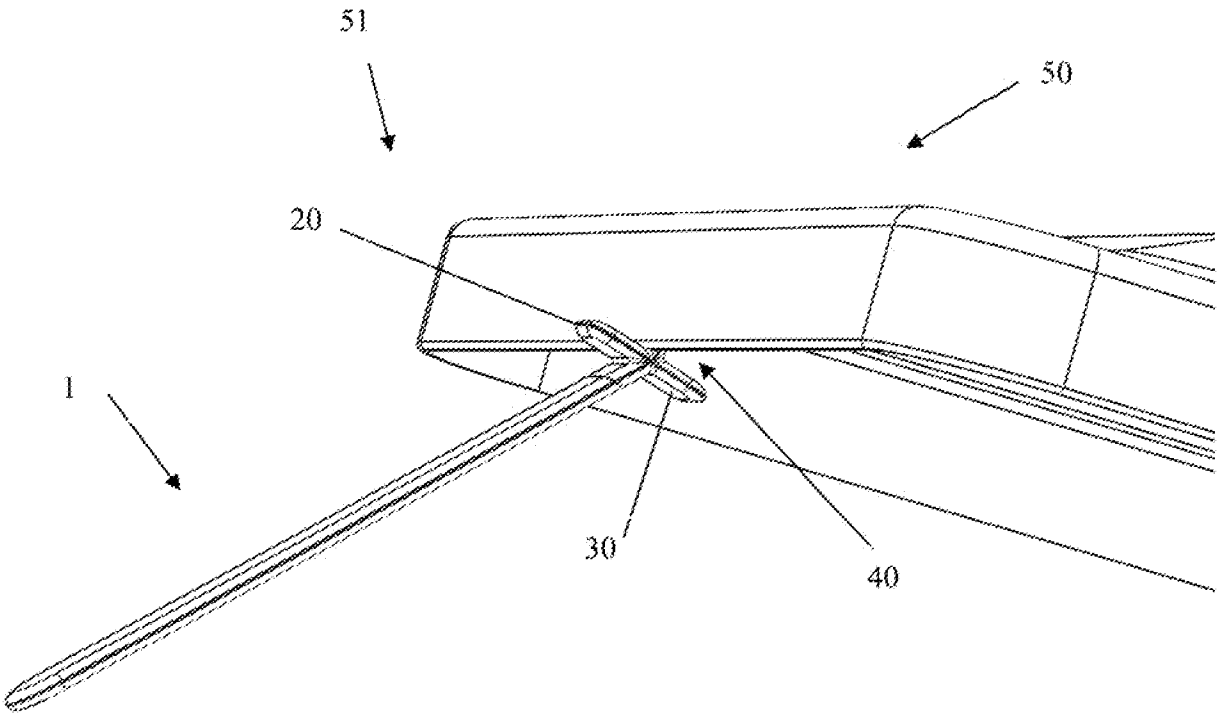

FIG. 5C illustrates another pushing action of the lid opener 1. The lid of the trash receptacle 50 is engaged between the first prong 20 and the third prong 40. In this orientation, second prong 30 extends in a direction toward the trash receptacle 50. The push action is initiated such that the user pushes the lid upwards with the lid opener 1, thereby applying a force to rotate open the lid.

Figure 5D:
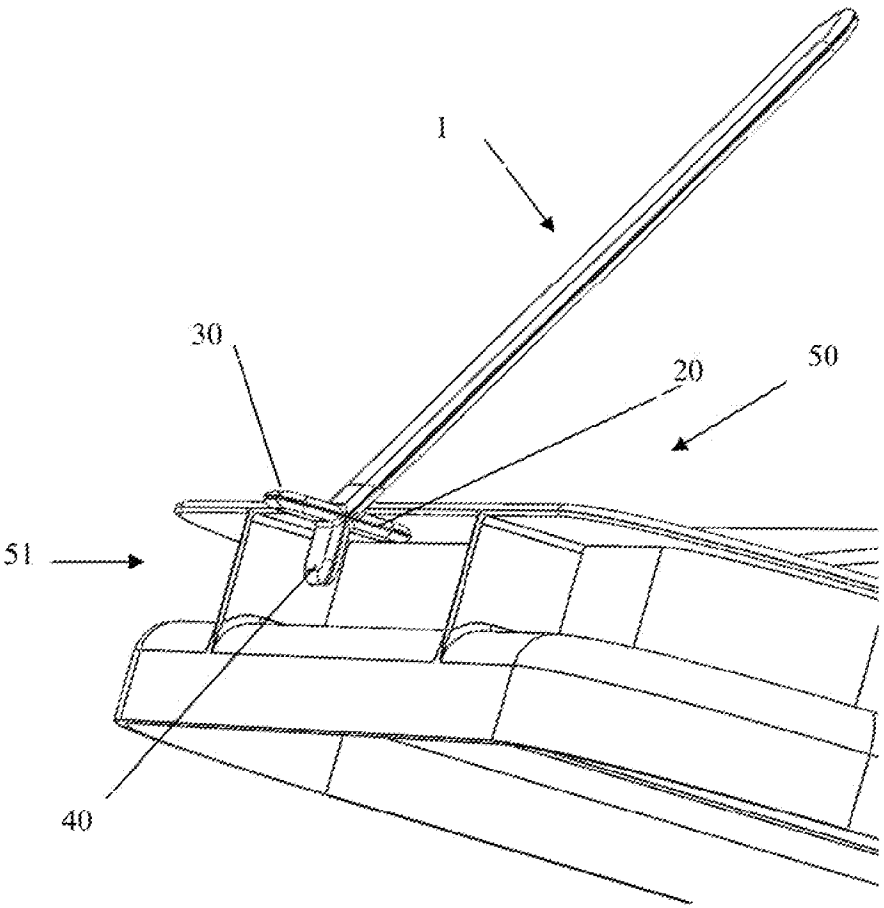

FIG. 5D illustrates a pulling action of the lid opener 1 to open lid 50. The lid opener is inverted such that the lid of the trash receptacle 50 is engaged between the first prong 20 and the handle 10. In this orientation, second prong 30 extends away from the trash receptacle 50. Inverting the lid opener 1 allows a user to lift and open the lid with a pulling action instead of a pushing action. As examples, this usage may be for users who are taller or if the lid is opened from behind. This method may also be used for opening trash receptacles with handles.

FIGS. 6A-6L are various views illustrating an embodiment of an apparatus configured to hold and store a lid opener, in accordance with aspects of the present invention, e.g., lid opener 1.

The lid opener 1 may be stored near or away from the trash receptacle. The lid opener 1 may be stored on a wall via a hanging, mechanical, and/or magnetic holder. In some embodiments, a trash receptacle may be configured to include such a holder, so that the lid opener is stored on the trash receptacle, whether the trash receptacle that the trash is transferred to or transferred from.

Figure 6A:
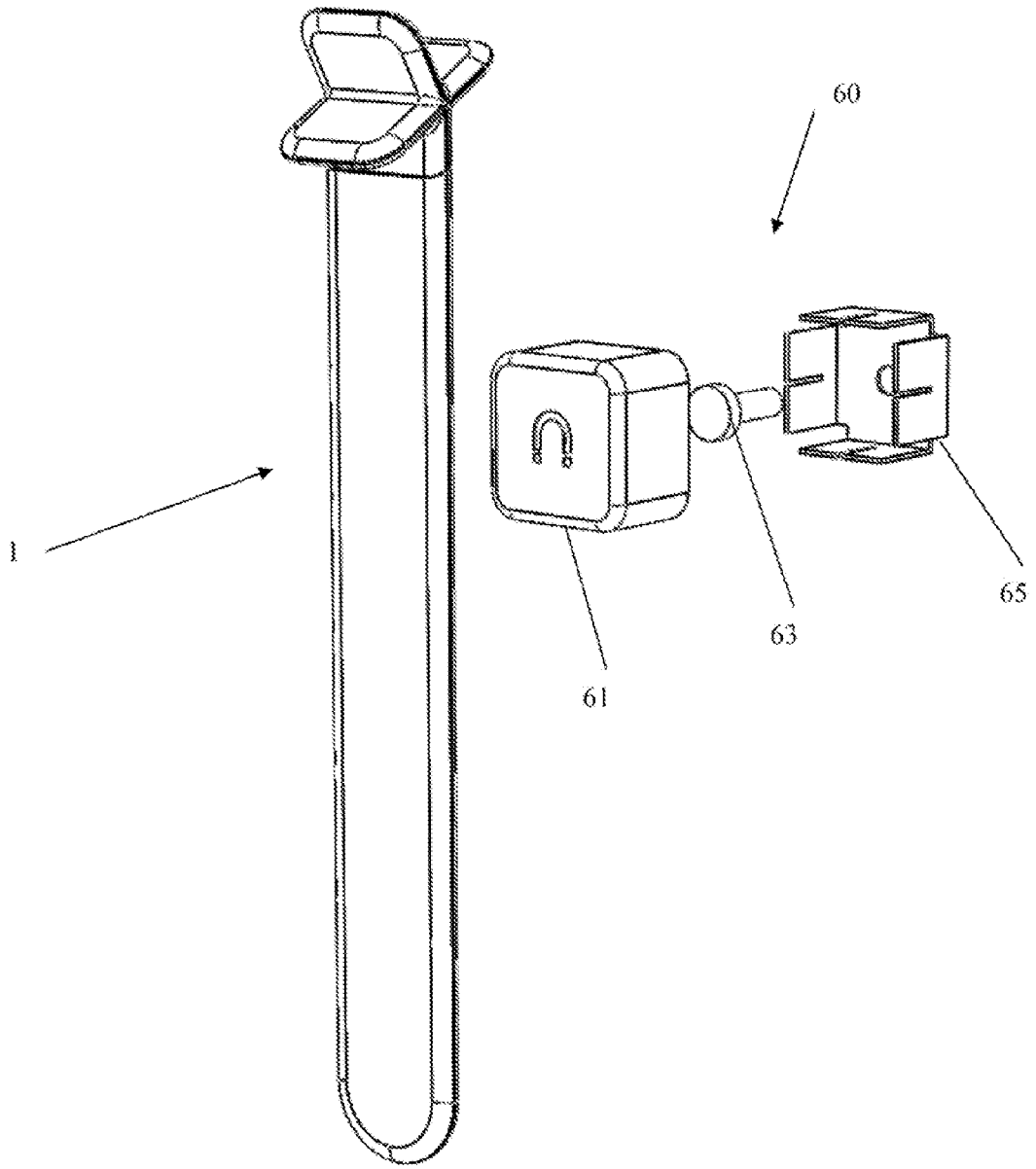
FIGS. 6A-6L are perspective views illustrating different embodiments of an apparatus that holds the lid opener of FIGS. 1A-1C.
Figure 6B:
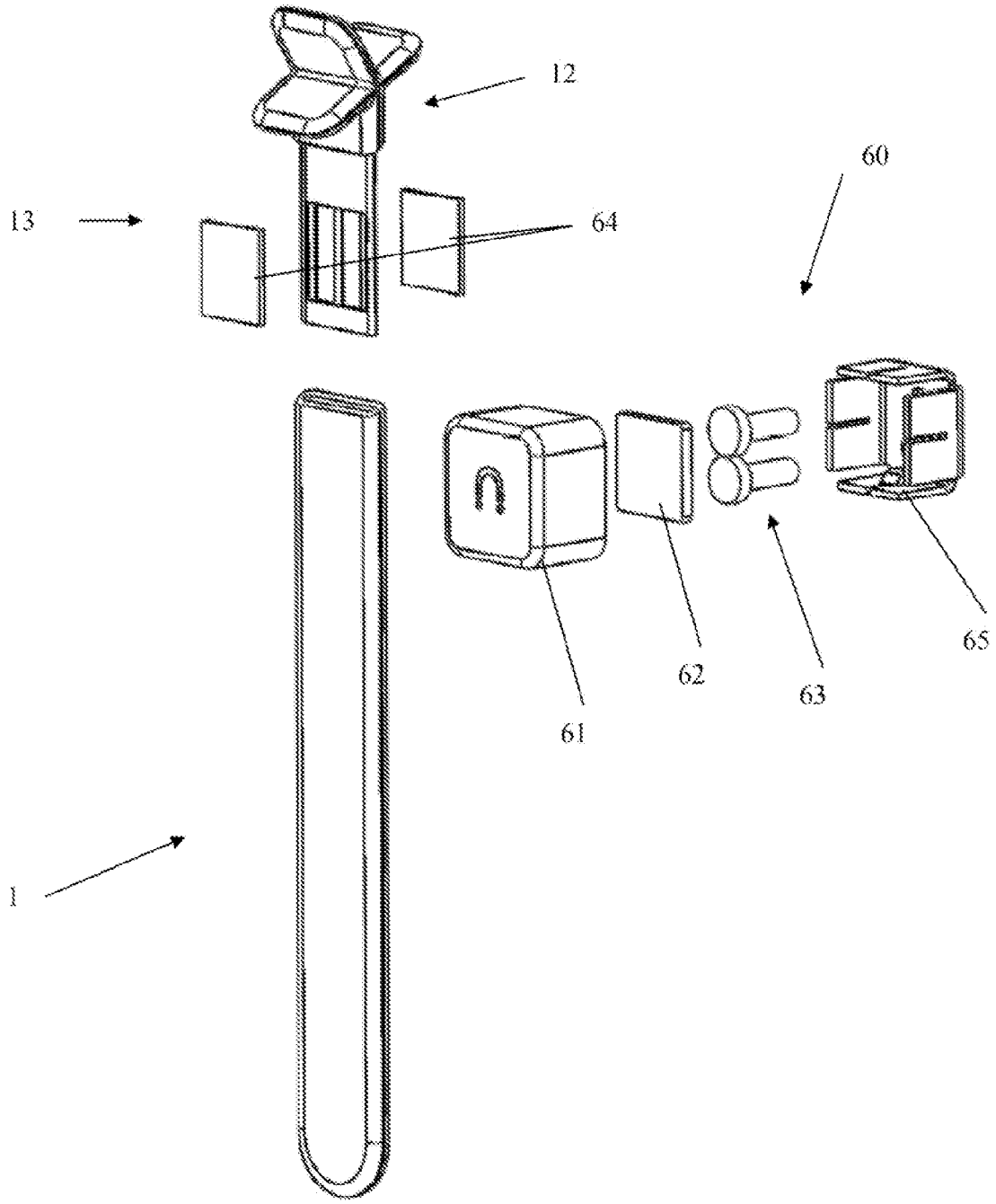

Referring to FIGS. 6A-6E, the lid opener 1 may be attached and stored on a wall (or other vertical surface) by a magnetic lid opener mount 60 that allows the lid opener 1 to be removed from the wall with minimal effort. A magnet may reside in either the lid opener mount 60, as illustrated in FIGS. 6A and 6B, or in the lid opener 1. A metallic insert can be placed into or part of the lid opener 1 or lid opener mount 60, depending on which includes the magnet, to complete the interaction.

Figure 6C:
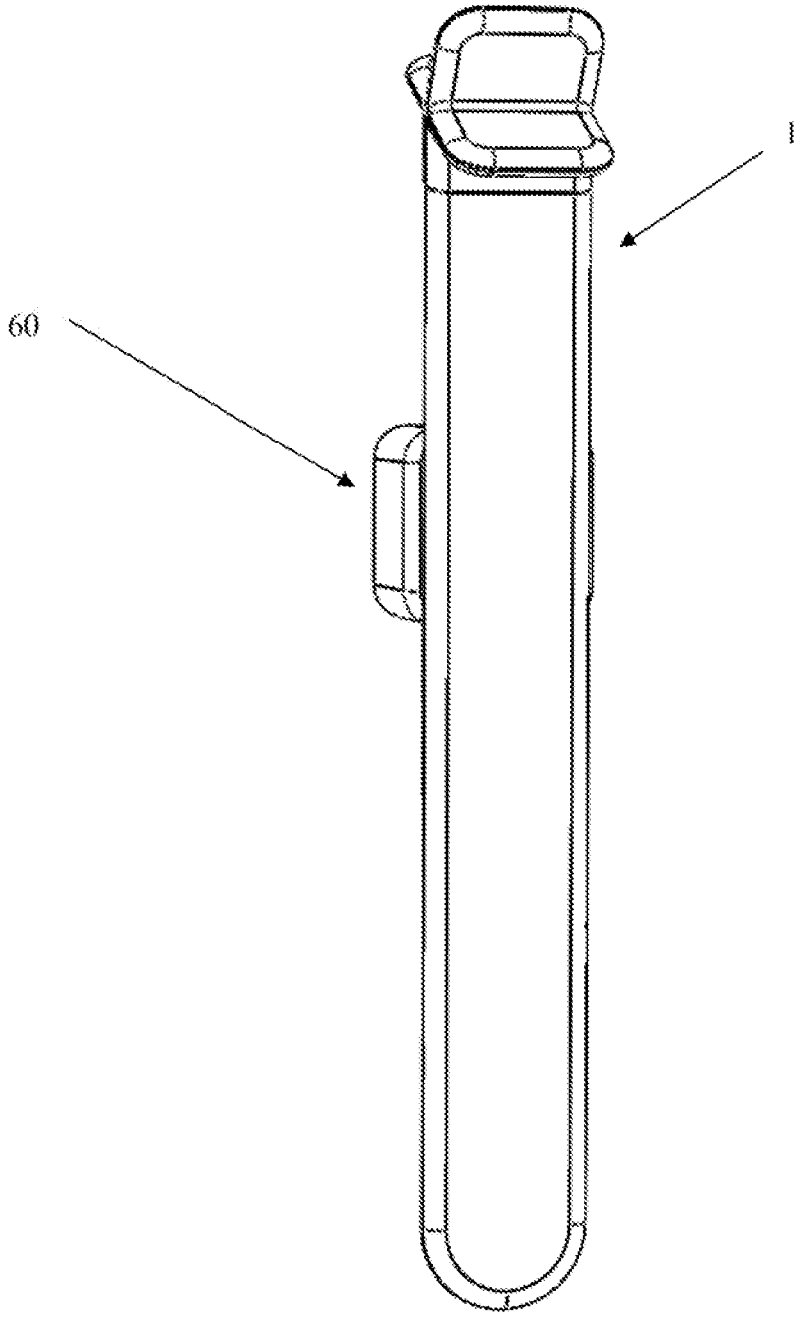
Figure 6D:
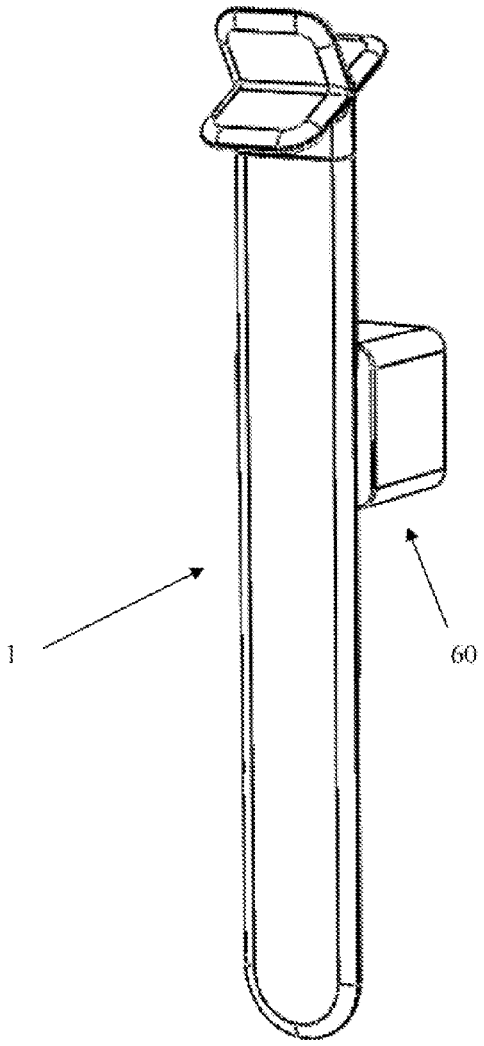
Figure 6E:
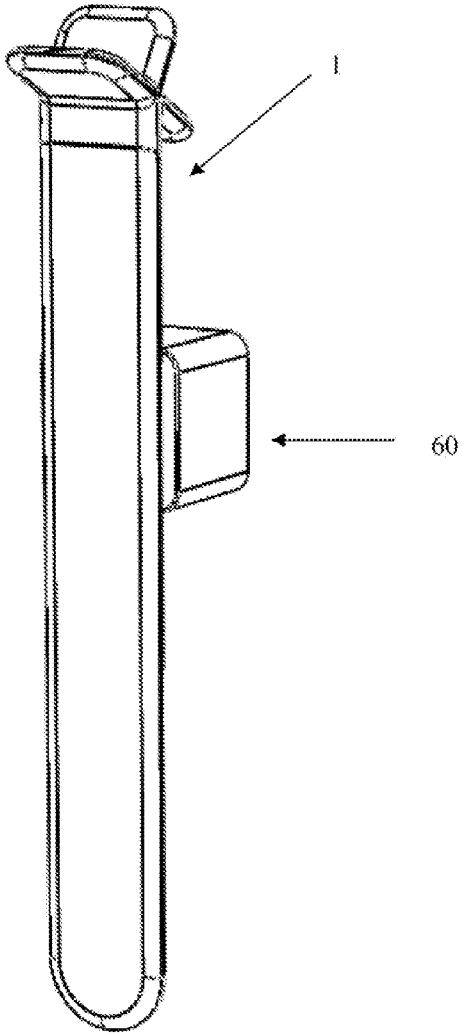

As illustrated in FIG. 6A, the magnetic lid opener mount 60 can include a bracket 65, for example a metal bracket, and at least one screw 63, for example, a wood, metal, or drywall screw. The magnetic lid opener mount 60 may include additional screws. The bracket 65 may be mounted to a wall, using such screw 63. The bracket 65 may be mounted to the wall by a device other than the screw 63. The magnetic lid opener mount 60 may further include a cover 61, for example, a plastic cover or housing, with a magnet 62 (not shown, but see, as an example, part 62 in FIG. 6B). The lid opener 1 may include a metallic insert (not shown, but see, as an example, parts 64 in FIG. 6B) or may be formed to include a magnetic material, e.g., a metal, such that the magnet in the magnetic lid opener mount 60 magnetically attracts the lid opener 1 thereto, as illustrated in FIGS. 6C-6E. For example, the single piece lid opener 1 of FIG. 1A may be made from or to include a magnetic material (e.g., a metal). In a two-piece embodiment, the first and/or second part may be formed of or include a magnetic material, for example, head 15 or core 13. As illustrated in FIGS. 6D and 6E, the magnetic lid opener mount 60 and lid opener 1 may be configured to securely engage on either side of the handle of the lid opener 1.

FIG. 6B provides an embodiment of lid lifter 1 with a magnetic attachment configuration, similar to that shown in FIG. 6A. Here, as in FIG. 6A, the magnetic lid opener mount 60 includes a bracket 65, at least one screw 63, and a cover 61. In this embodiment, at least one magnet 62 is maintained by or within mount 60. Correspondingly, one or more metal pieces can arranged within or form part of rigid core 13 of neck 12 of the lid opener 1, shown in a 2-piece embodiment of lid opener 1. In other embodiments, the metal could be in or form part of mount 60 and one or more magnets could be in or form part of lid lifter 1.

Magnets may or may not be included on the lid lifter, in some embodiments. In various embodiments, therefore, magnets may or may not be included in the handle portion or the wall hanger block. That is, for example, other manners of hanging or mounting lid lifter 1 may be used, some if which are described herein.

Figure 6F:
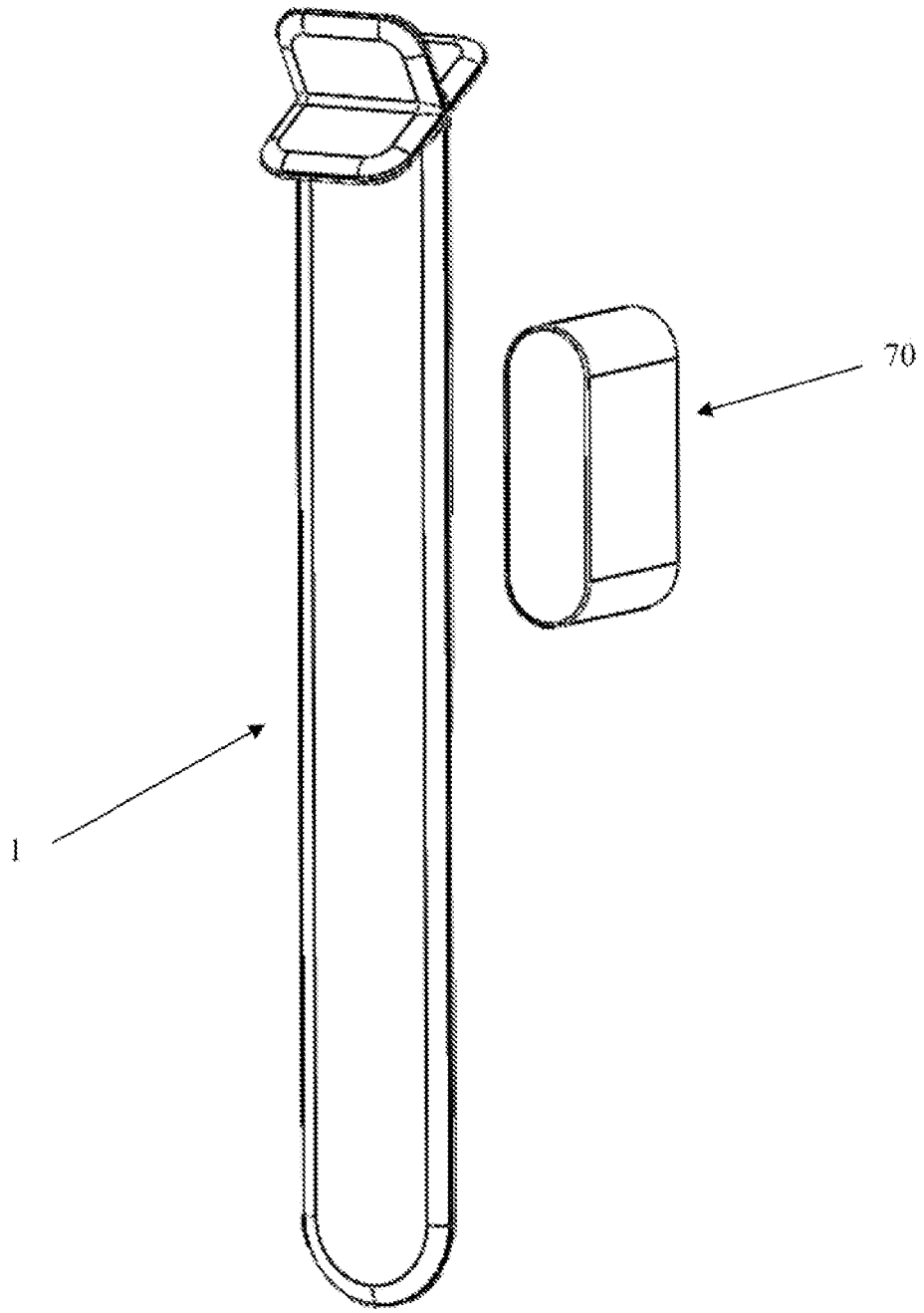
Figure 6G:
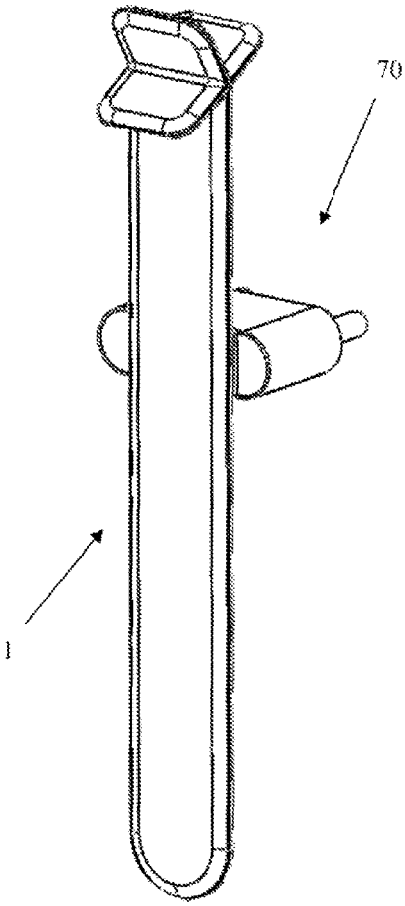
Figure 6H:
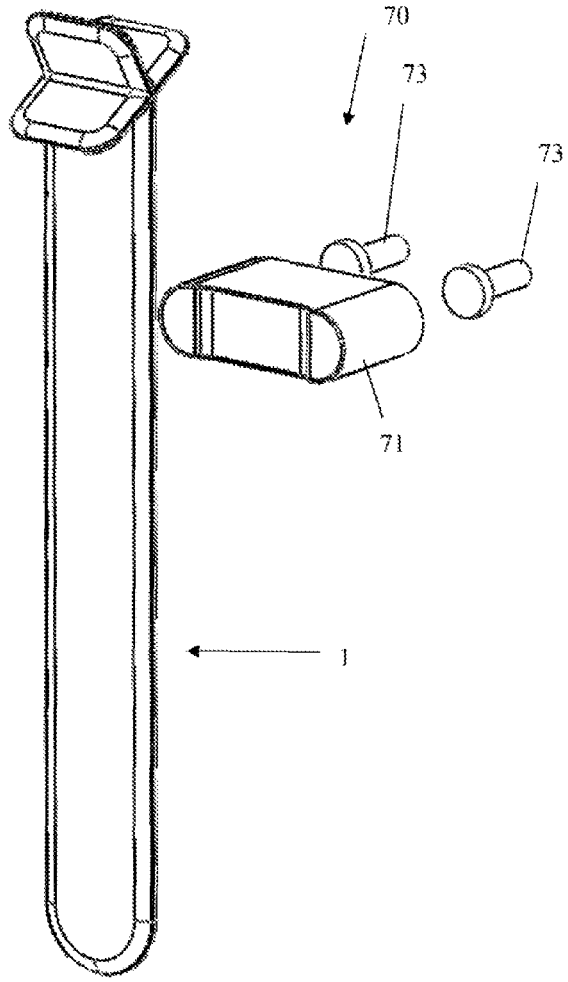

The shapes of the cover 61 and the bracket 65 (see FIGS. 6A and 6B) are not limited to that of a square, as illustrated in FIGS. 6A-6E. As illustrated in the embodiment of FIGS. 6F-6H, a magnetic lid opener mount 70 may be slim, for example, in the shape of an oval. In some embodiments, the magnetic lid opener mount 70 may include a channel within the cover 71 for orienting the lid opener 1, for example, as shown in FIGS. 6G and 6H. The magnetic lid opener mount may include first and second screws 73 for mounting the magnetic lid opener mount 70 to the wall (or other vertical surface), for example, also as shown in FIGS. 6G and 6H.

Figure 6I:
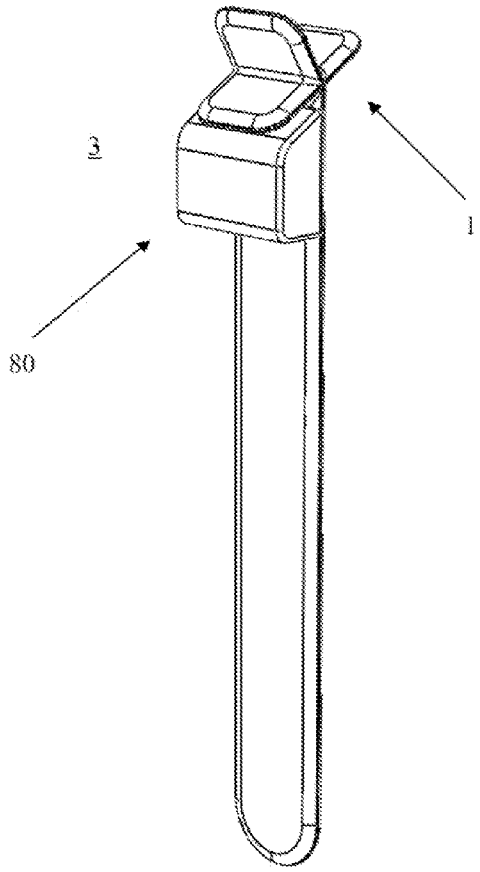
Figure 6J:
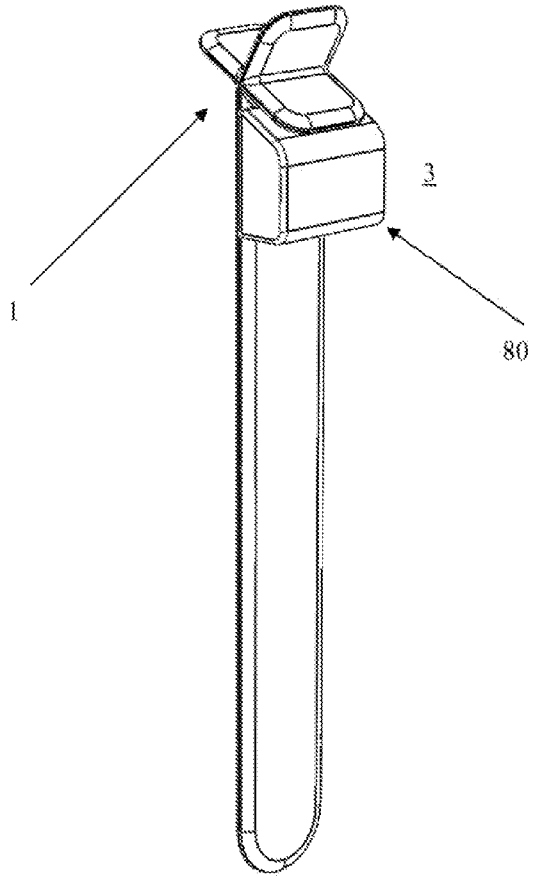
Figure 6K:
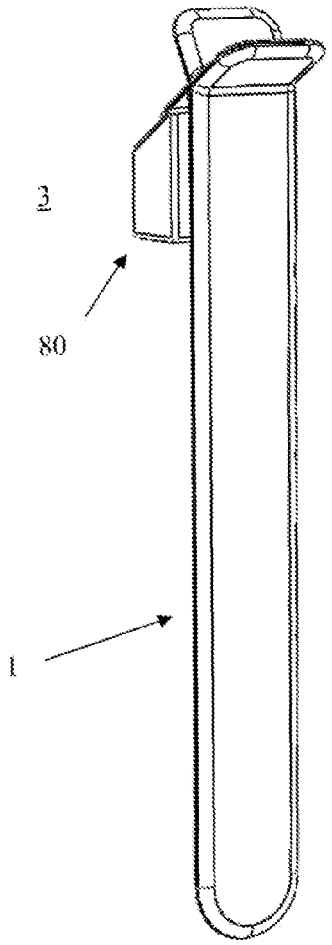

FIGS. 6I-6K illustrate another embodiment of a lid opener mount 80 in the form of a block that can be screwed to a wall, a post, or other vertical surface or object. The lid opener mount 80 includes a slanted portion on which the first prong 20 rests. FIGS. 6I and 6J illustrate the lid opener 1 hanging from the lid opener mount 80. In FIG. 6K, the slant of the lid opener mount 80 extends up and out from the wall such that the lid opener 1 hangs therefrom. In such embodiments, the mount may include a magnet, but need not.

Figure 6L:
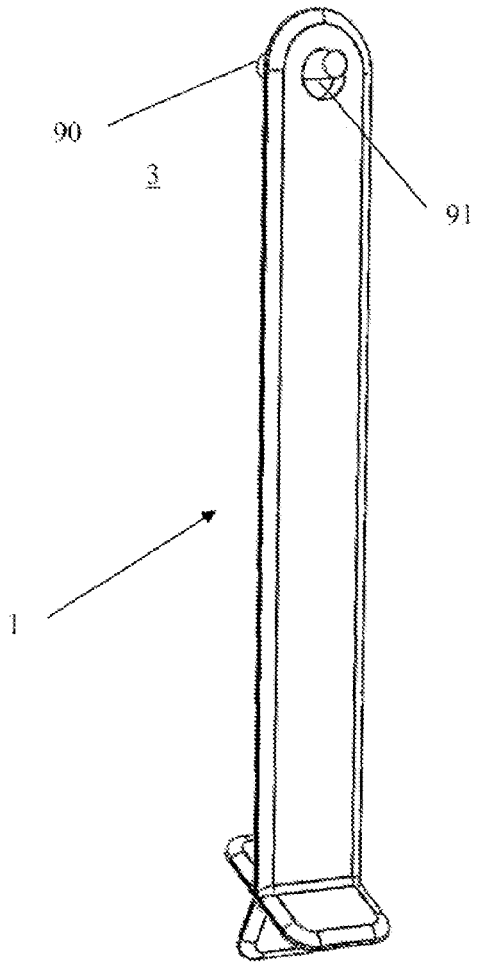

FIG. 6L illustrates another embodiment of a lid opener mount 90 is a projection that extends from the wall or other vertical surface. The lid opener mount 90, as examples, may take the form a post, a peg, or a screw. To accommodate such mounts, the lid opener 1 may include an opening 91 formed therein for a hook (not shown). The lid opener mount 90 is configured to extend through the opening 91 such that the lid opener 1 hangs on the lid opener mount 90. In this embodiment, the mount is a peg, but in other embodiments it could be a hook.

In various embodiments, a lid opener kit can comprise a lid opener and a lid opener mount, e.g., as described herein.

FIGS. 7A-7E are perspective views of another embodiment of a lid opener 100, in accordance with the inventive concepts. The lid opener 100 can be reconfigurable, as is shown in these embodiments.

As illustrated in FIGS. 7A-7E, the lid opener 100 may include a head 115 having at least one prong 104 extending from a handle 102. The position of head 115, and therefore the position of prong 104, can be adjustable via an adjustment mechanism. The position of the prong 104 along the length of the handle 102, as well as its orientation, may also be adjustable. That is, either portion of head 115 can be coupled to the handle 102. The prong 104 is configured to engage a lid for opening, either by pull or push, depending on the position of prong 104 with respect to handle 102. The prong 104 can include a bend 106 which helps retain a lid of a trash receptacle.

As shown in FIGS. 7A-7E, the handle 102 and head 115 may each include portions with openings 110, 120, respectively, defined therein, forming at least portions of the adjustment mechanism. In this embodiment, the openings 110, 120 are comprised of a series of round holes of the same or similar diameters. Respective holes of the handle 102 and head 115 can be aligned to enable a nut and bolt, screw, clip, or the like 117 to be inserted into the holes to couple the handle 102 and head 115 together, in a desired orientation. As an example, in some embodiments, the holes 110, 120 of either the handle 102 or head 115 can be threaded to receive a correspondingly threaded screw 117.

In another embodiment, the handle 102 and head 115 can be permanently coupled together, but still adjustable, e.g., with a spring loaded coupling (not shown) that locks the two together in engagement, but allows the two pieces to be sufficiently disengaged to enable adjustment (e.g., sliding and/or turning) of the head 115 with respect to the handle 102.

Figure 7C:
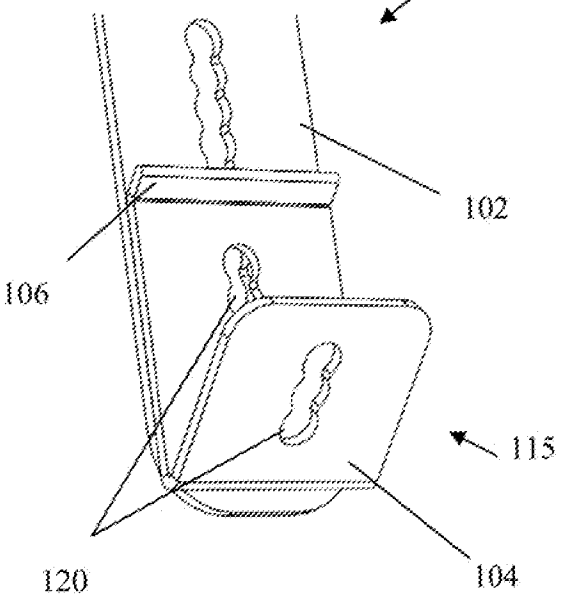
FIGS. 7A-7E are perspective views of another embodiment of lid opener, in accordance with the inventive concepts.
Figure 7B:
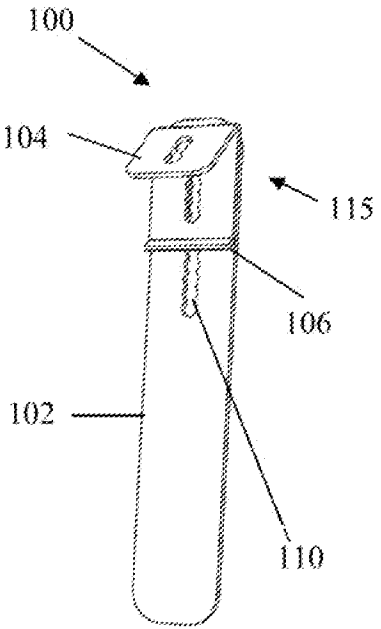
Figure 7A:
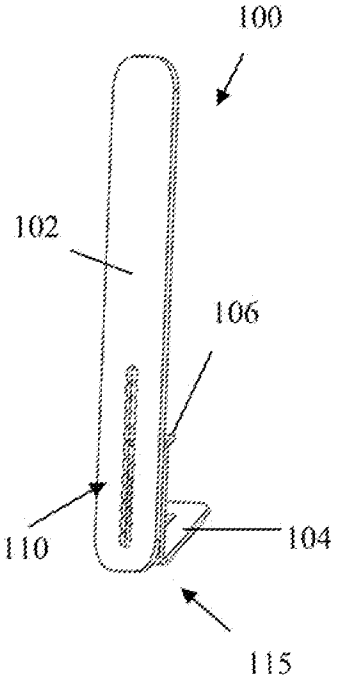
Figure 7D:
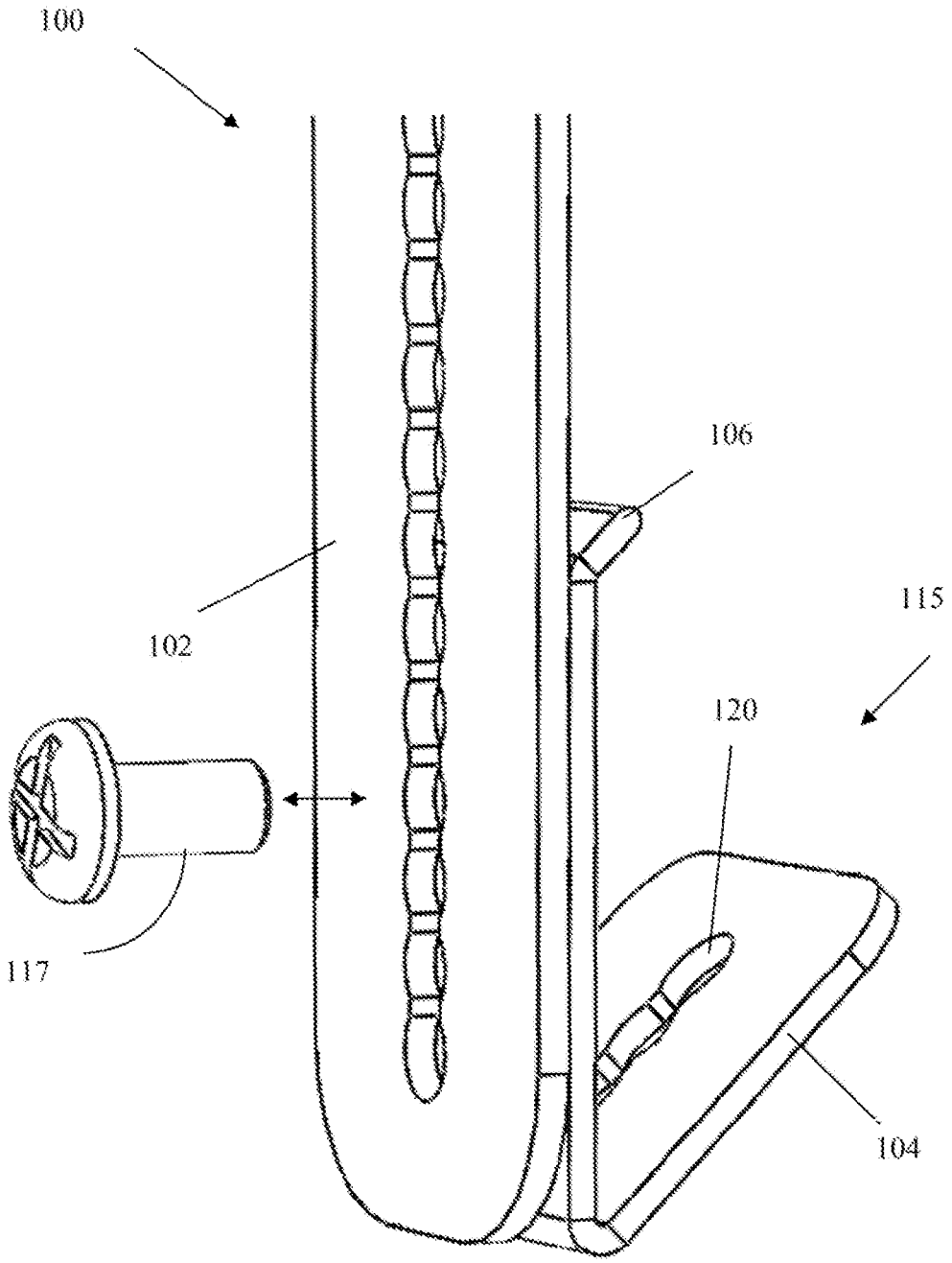
Figure 7E:
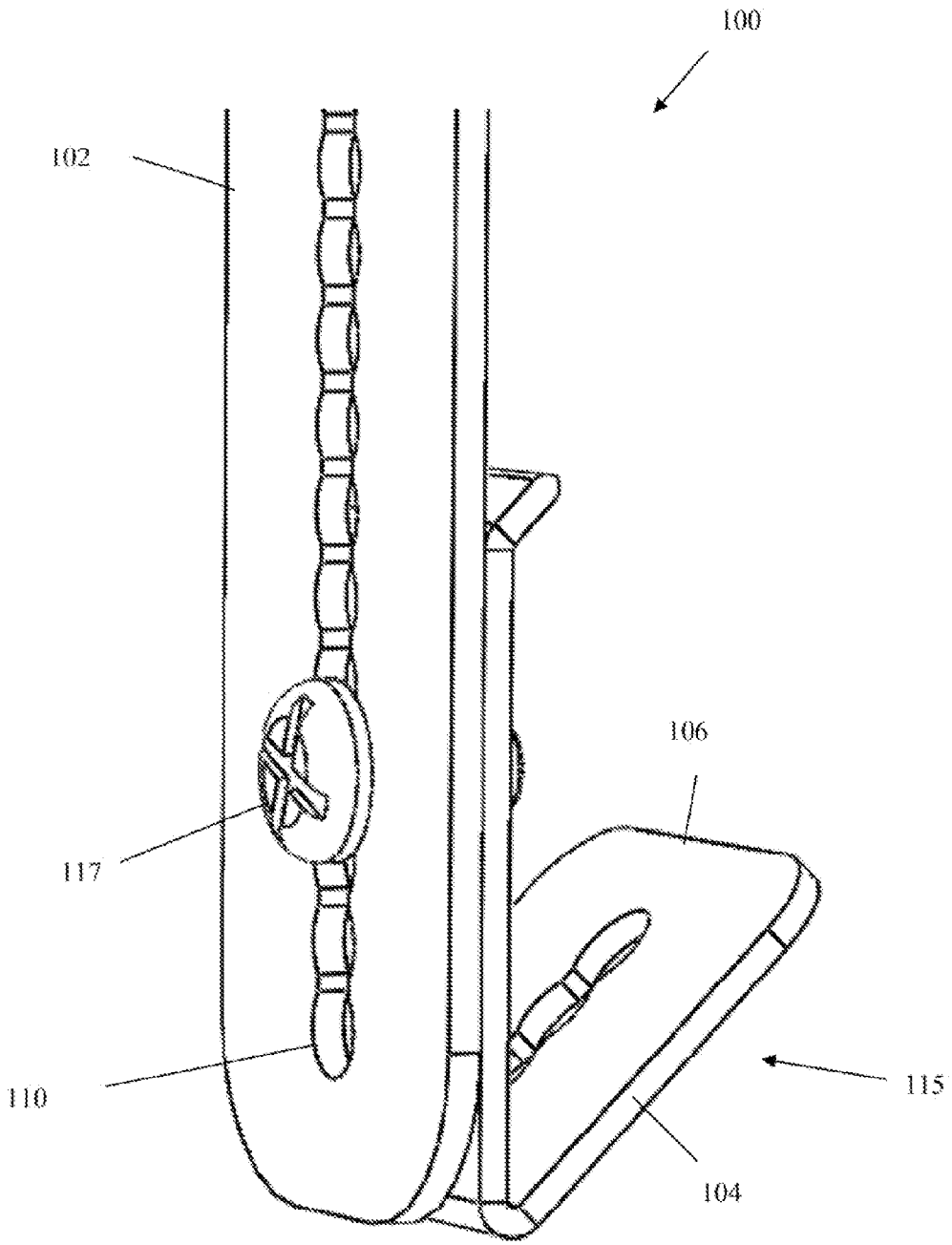

FIG. 7D shows one orientation of one portion of head 115 to be coupled to handle 102 and FIG. 7E shows another orientation of another portion of head 115 to be coupled to handle 102. Depending on the orientation of the head 115 to the handle 102, the lid opener 100 can take different forms.

Figure 8C:
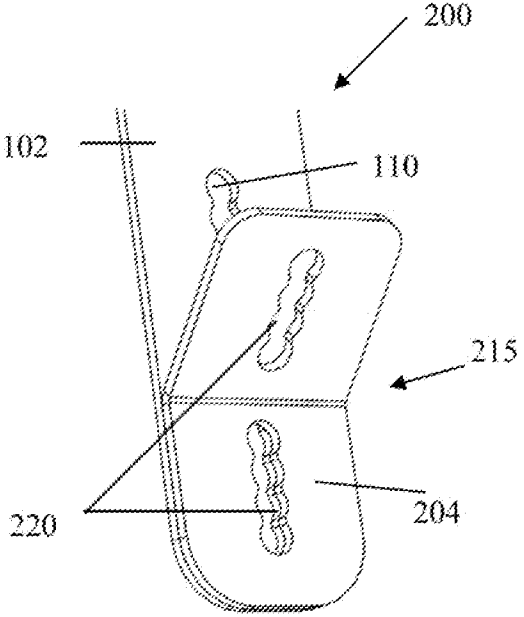
FIGS. 8A-8C are perspective views of another embodiment of a lid opener, in accordance with the inventive concepts.
Figure 8B:
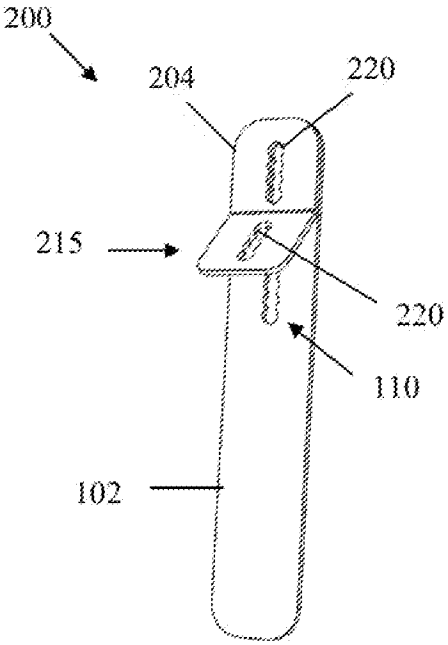
Figure 8A:
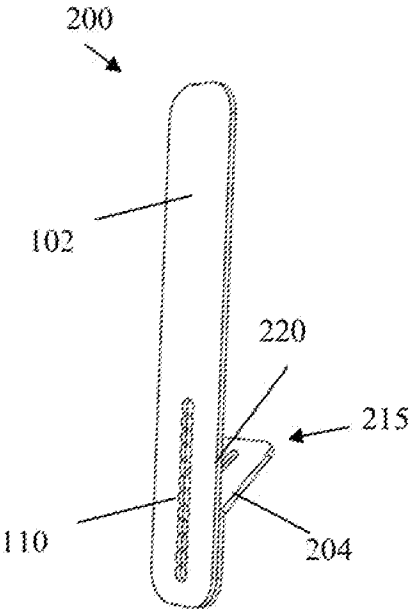

FIGS. 8A-8C are perspective views of another embodiment of a lid opener 200, in accordance with the inventive concepts. The lid opener 200 can be reconfigurable, as with the embodiment of FIGS. 7A-7E. In this embodiment, the lid opener may include handle 102 of FIGS. 7A-7E, but a different head.

As illustrated in FIGS. 8A-8C, the lid opener 200 may include a head 215 having at least one prong 204 extending from the handle 102. The position of the head 215, and therefore the prong 204, is adjustable with respect to the handle 102, via an adjustment mechanism. For example, the position of the head 215 along the length of the prong 204 may be adjustable.

The handle 102 and the head can have formed therein respective openings 210 and 220, forming at least part of the adjustment mechanism, along with a nut and bolt, screw, clip, spring-loaded mechanism or the like to be inserted into the holes to couple the handle 102 and head 215 together, in a desired orientation, as discussed above with respect to FIGS. 7A-7E. The orientation of the prong 204 can be adjustable such that lid opener 200 can have a double use of pulling and pushing.

Figure 9C:
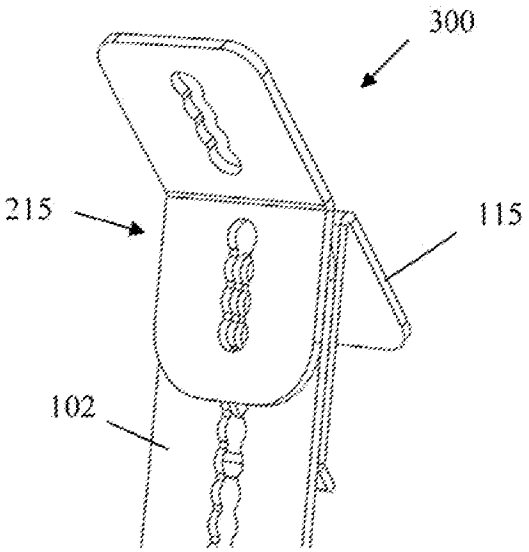
FIG. 9A-9F are perspective views of yet another embodiment of a lid opener, in accordance with the inventive concepts.
Figure 9B:
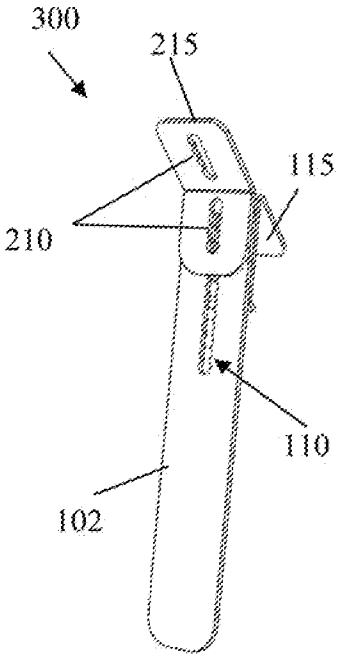
Figure 9A:
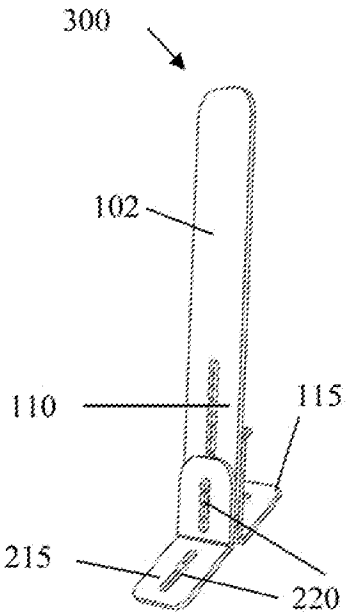
Figure 9F:
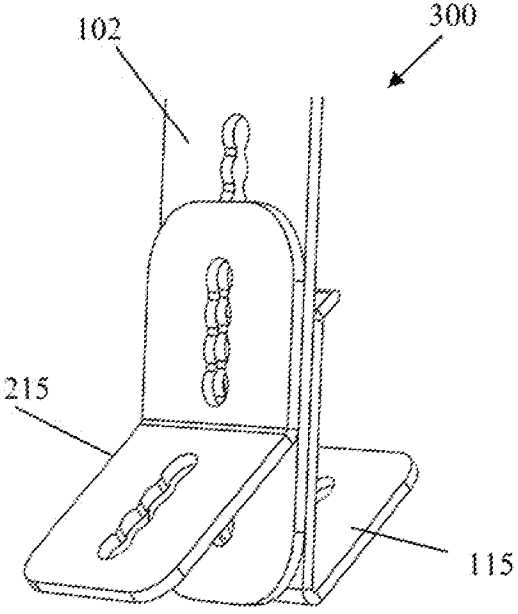
Figure 9E:
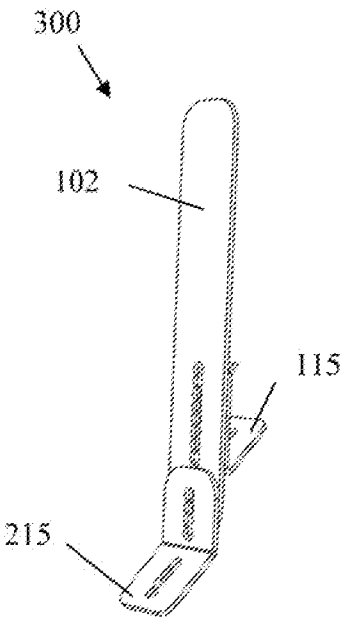
Figure 9D:
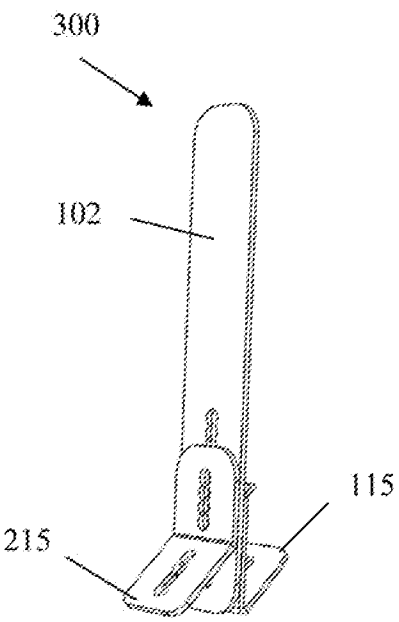

FIG. 9A-9C are perspective views of another embodiment of a lid opener 300, in accordance with the inventive concepts. The lid opener 300 can be reconfigurable. In this embodiment, the lid opener 300 includes handle 102, head 115 and head 215.

As illustrated in FIGS. 9A-9C, the lid opener 300 may accommodate various orientations of head 115 and head 215 on handle 102, as discussed above. The heads 115, 215 can be coupled to handle 102 via adjustments mechanisms described above, wherein each had may have its own adjustment mechanism or they may share a common adjustment mechanism.

Figure 10A:
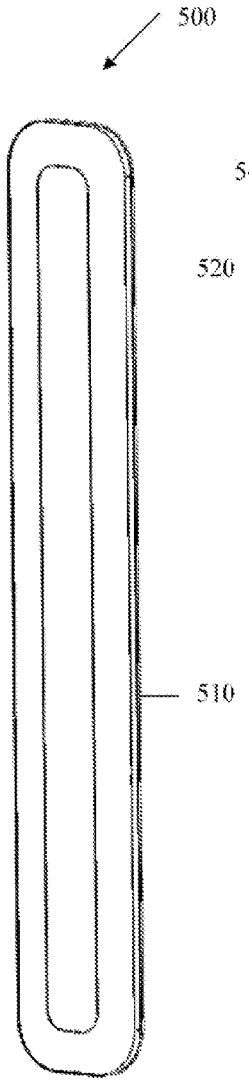
FIGS. 10A-10C are perspective views of three different embodiments of a lid opener, in accordance with the inventive concepts.
Figure 10B:
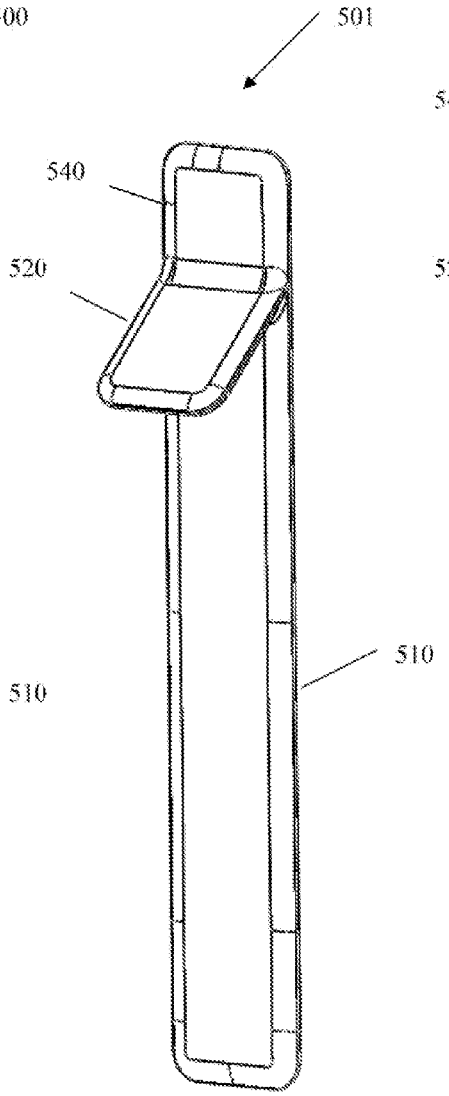
Figure 10C:
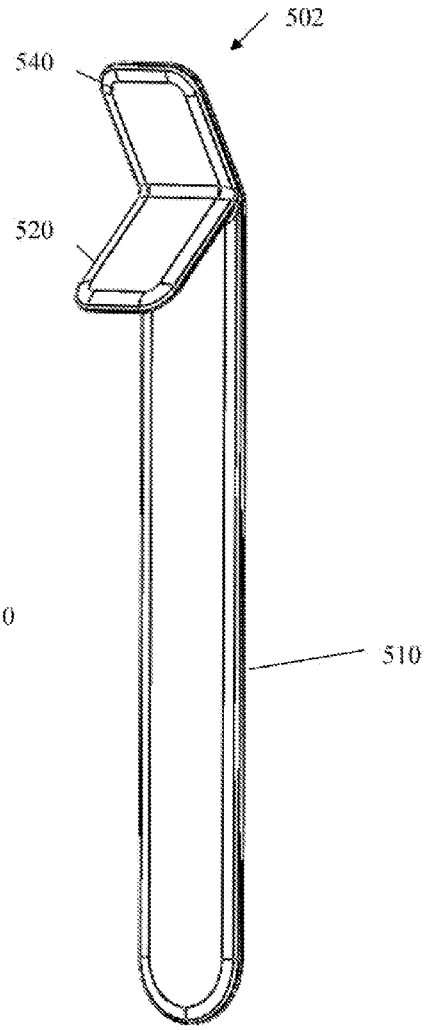

FIGS. 10A-10C are perspective side views of lid openers 500, 501 and 502, respectively, in accordance with the inventive concepts.

In the embodiment of FIG. 10A, the lid opener 500 includes no prongs. The lid opener includes only handle 510.

In the embodiment of FIG. 10B, the lid opener 501 includes a single, first projection member, or prong, 520 extending from the handle 510. As illustrated, in FIG. 10B, the first prong 520 may extend from the handle 510 at an angle and be displaced from a distal end of the handle by a relatively small amount to effectively achieve a straight prong 540, formed by the distal end of the handle 510, and an angled prong 520. In this embodiment, the prong 520 has a downward angle, but in other embodiments it could have an upward angle.

In the embodiment of FIG. 10C, the lid opener 502 includes first and second prongs 520 and 540 extending from a handle 510. As illustrated, in FIG. 10C, the first prong 520 may extend from the handle 510 at an angle and the second prong 540 may also extend from the handle 510 at a different angle. As a result, multiple lid engagements, e.g., between two prongs, between a prong and handle, and/or with a single prong, are achieved.

In these embodiments, the lid openers 500, 501 and 502 may be unitary (single piece) devices, but in other embodiments they can be multi-piece, as described above. In these embodiments, the lid openers 500, 501 and 502 have fixed lengths.

Figure 11A:
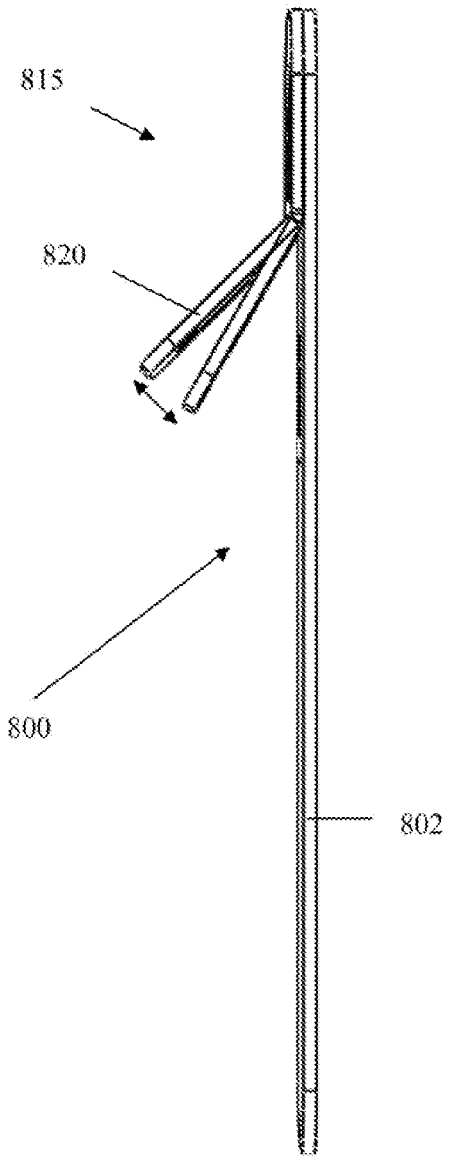
FIGS. 11A and 11B are perspective views of two different embodiments a lid opener, in accordance with the inventive concepts.
Figure 11B:
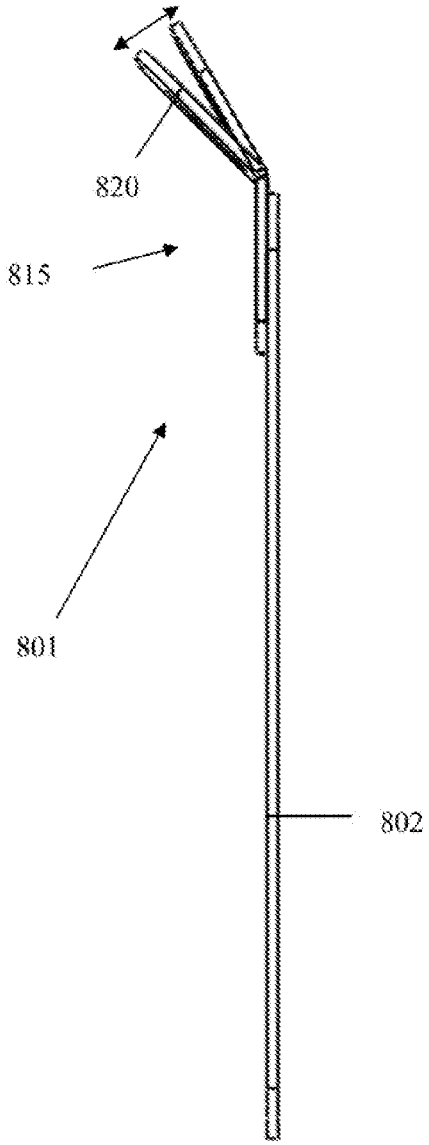

FIGS. 11A-11B are perspective views of other embodiments of a lid opener, as lid openers 800 and 801, in accordance with the inventive concepts. As illustrated in FIGS. 11A and 11B, the lid openers 800 and 801 may each include a head 815 coupled to a handle 802. The head 815 can have one or more prongs 820 that is adjustable at different angles. That is, in FIGS. 11A-11B, a single prong is illustrated at different angles.

In FIG. 11A, the head 815 is oriented so the prong 820 is generally oriented at a downward angle with respect to handle 802. In FIG. 11B, the head 815 is oriented so the prong 820 is generally oriented at an upward angle with respect to handle 802.

Figure 12A:
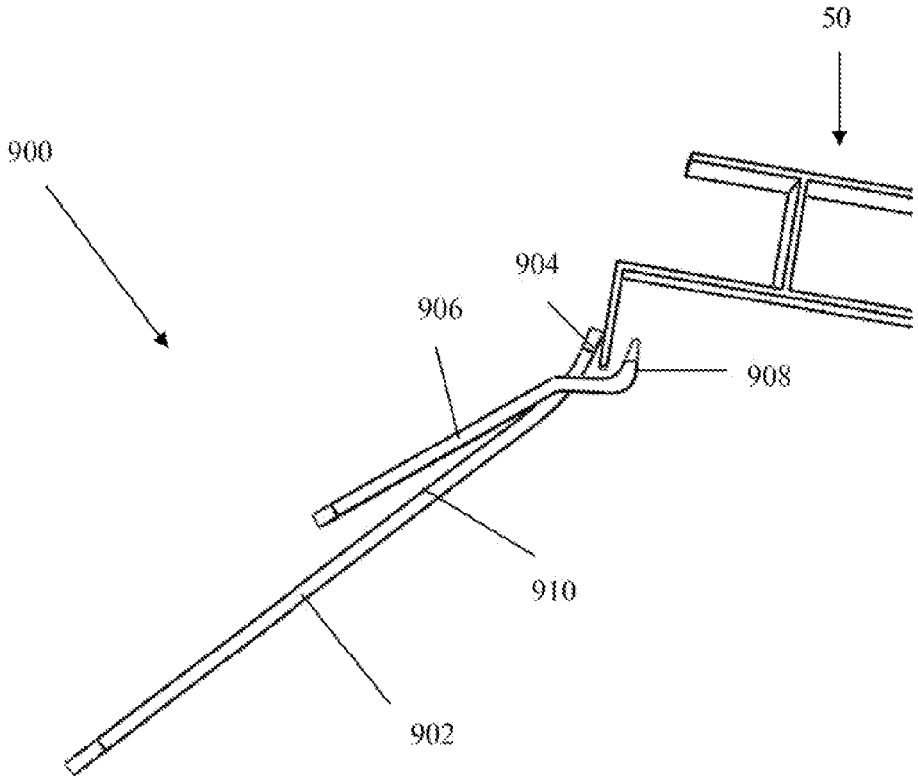
FIGS. 12A and 12B are perspective views of another embodiment of a lid opener, in accordance with the inventive concepts.
Figure 12B:
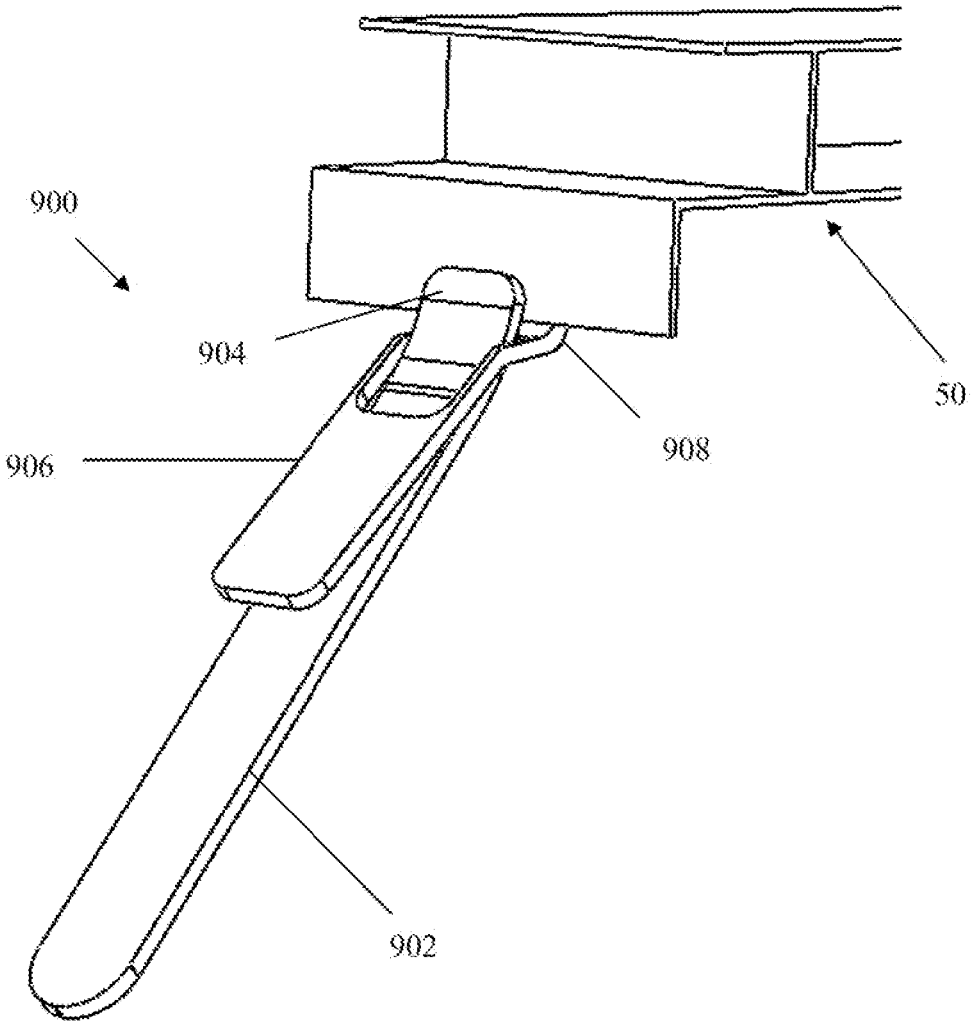

FIGS. 12A-12B are perspective views of another embodiment of a lid opener 900, in accordance with the inventive concepts.

The lid opener 900 may include a movable, mechanical prong configured to grip a lid of a trash receptacle with a spring and thumb control. The lid opener 900 includes a first prong 906 having a hooked end portion 908, a second prong 902 having an end portion 904 and a spring 910 positioned between the two. The lid opener is configured to enable a user to squeeze the first and second prongs 906 and 902 together to force the end portions 908 and 904 to open and then the spring 910 returns them to a closed position to clamp the lid of the trash receptacle.

In the foregoing embodiments, various angles of prongs are provided. Such angles reflect presently preferred embodiments. Small variations may be permitted in various embodiments, for example, such angles may vary by +/−10 degrees. Therefore, as an example an angle of 60 degrees may be characterized as substantially 60 degrees, to include variations of +/−10 degrees. In some embodiments, the head may be rotatable with respect to the handle, e.g., 30, 60, 90, or 180 degrees with respect to the handle.

While the foregoing has described what are considered to be the best mode and/or other preferred embodiments, it is understood that various modifications can be made therein and that the invention or inventions may be implemented in various forms and embodiments, and that they may be applied in numerous applications, only some of which have been described herein. It is intended by the following claims to claim that which is literally described and all equivalents thereto, including all modifications and variations that fall within the scope of each claim.

What is claimed is:

1. A lid opener, comprising:

a handle;

an opening mechanism extending from the handle, the opening mechanism comprising a plurality of projection members configured to engage a portion of a lid, wherein at least one of the projection members extends from the handle at a non-zero angle with respect to the handle, wherein the plurality of projection members consists of first, second, and third projection members, and the first projection member extends outward from the handle in a first direction at a first angle, the second projection member extends outward from the handle in a second direction at a second angle, and a third projection member extends outward from the from the handle in a third direction and between the first and second projection members, wherein the first direction is a downward direction and the first angle is about a 60° angle from a first side of the handle, wherein the second direction is an upward direction and the second angle is about a 120° angle from a second side of the handle, wherein the second side of the handle is opposite the first side of the handle.

2. The lid opener of claim 1, wherein an angle between the third projection member and each of the first and second projection members is substantially 90°.

3. The lid opener of claim 2, wherein the third projection member is substantially perpendicular to the second projection member.

4. The lid opener of claim 1, wherein corners between each of the projection members and between the projection members and the handle are filleted.

5. The lid opener of claim 1, wherein the handle and the opening mechanism are a unitary device.

6. The lid opener of claim 1, wherein the handle comprises a rigid core and the handle comprises a grip overmolded around the core.

7. The lid opener of claim 6, wherein the grip comprises at least one of plastic, rubber, urethanes, thermosets or a combination thereof.

8. The lid opener of claim 1, wherein at least one of the projection members is adjustable with respect to the handle.

9. The lid opener of claim 1, wherein the first and second projection members have a common vertex.

10. The lid opener of claim 1, wherein the handle has a flat gripping surface.

11. The lid opener of claim 1, wherein an angle between the first and second projection members is substantially 180°.

12. A lid opener, comprising:

a handle; and a head mechanism, comprising:

a first prong extending in a first direction at a first angle;

a second prong extending in a second direction at a second, the second direction being opposite the first direction; and a third prong extending in a third direction, the third prong extending between the first and second prongs, wherein the first direction is a downward direction with respect to a first side of the handle, wherein the first angle is a substantially 60° angle from a first side of the handle and wherein the second direction is an upward direction and the second angle is a substantially 120° angle from a second side of the handle, wherein the second side of the handle is opposite the first side of the handle.

13. The lid opener of claim 12, wherein the handle has a flat gripping surface and the first, second, and third prongs have flat engagement surfaces.

* * * * *